US009038288B2

(12) United States Patent
Droege et al.

(10) Patent No.: US 9,038,288 B2
(45) Date of Patent: May 26, 2015

(54) ATHLETIC FOOTWEAR WITH BALL CONTROL PORTIONS

(75) Inventors: John Droege, Portland, OR (US); Doug D. Wilken, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 837 days.

(21) Appl. No.: 13/245,081

(22) Filed: Sep. 26, 2011

(65) Prior Publication Data

US 2013/0074374 A1 Mar. 28, 2013

(51) Int. Cl.

*A43B 5/02* (2006.01)
*A43B 23/02* (2006.01)
*A43B 7/24* (2006.01)

(52) U.S. Cl.

CPC ..... *A43B 23/0265* (2013.01); *A43B 5/025* (2013.01); *A43B 7/24* (2013.01)

(58) Field of Classification Search

CPC ..... A43B 5/025; A43B 23/0265
USPC ..... 36/133
See application file for complete search history.

(56) References Cited

U.S. PATENT DOCUMENTS

| | | | | |
|---|---|---|---|---|
| 3,650,051 | A * | 3/1972 | Sass | 36/133 |
| 5,216,827 | A | 6/1993 | Cohen | |
| 5,437,112 | A | 8/1995 | Johnston | |
| D431,351 | S | 10/2000 | Prats et al. | |
| D465,320 | S | 11/2002 | Weege | |
| 6,523,282 | B1 | 2/2003 | Johnston | |
| 6,681,503 | B2 * | 1/2004 | Morle | 36/99 |
| D573,339 | S | 7/2008 | Stauffer | |
| 7,487,605 | B2 | 2/2009 | Hatzilias | |
| 7,562,471 | B2 | 7/2009 | Minami | |
| D602,235 | S | 10/2009 | Hatzilias | |
| 8,196,322 | B2 * | 6/2012 | Atsumi et al. | 36/133 |
| 2003/0167658 | A1 | 9/2003 | Davis | |
| 2004/0055183 | A1 | 3/2004 | Lee et al. | |
| 2004/0088888 | A1 * | 5/2004 | Johnston | 36/133 |
| 2005/0268497 | A1 | 12/2005 | Alfaro et al. | |
| 2006/0174520 | A1 | 8/2006 | Wu | |
| 2008/0127524 | A1 | 6/2008 | Minami | |
| 2010/0299967 | A1 | 12/2010 | Atsumi et al. | |
| 2010/0331122 | A1 | 12/2010 | Morag | |

(Continued)

FOREIGN PATENT DOCUMENTS

| | | | |
|---|---|---|---|
| AU | 2008203180 | | 2/2009 |
| DE | 1805045 | | 1/1960 |
| DE | 2743666 | A1 * | 3/1978 |

(Continued)

OTHER PUBLICATIONS

International Preliminary Report on Patentability (including Written Opinion of the ISA) mailed Apr. 10, 2014 in International Application No. PCT/US2012/056996.

(Continued)

*Primary Examiner* — Ted Kavanaugh
(74) *Attorney, Agent, or Firm* — Plumsea Law Group, LLC

(57) ABSTRACT

An article of footwear includes a first ball control portion, a second ball control portion and a third ball control portion. Each ball control portion includes a group of gripping members configured to facilitate various types of ball control. Each group of gripping members is arranged so that the ball control portions present a series of approximately continuous edges to a ball, which can help maintain a smooth trajectory for a ball.

42 Claims, 16 Drawing Sheets

(56) References Cited

U.S. PATENT DOCUMENTS

| | | | | |
|---|---|---|---|---|
| 2012/0180340 | A1* | 7/2012 | Crowley et al. | 36/103 |
| 2012/0180341 | A1* | 7/2012 | Crowley et al. | 36/103 |

FOREIGN PATENT DOCUMENTS

| | | |
|---|---|---|
| DE | 2652055 | 5/1978 |
| DE | 2801984 | 7/1979 |
| GB | 2259639 | 3/1993 |
| JP | 9028412 | 2/1997 |
| JP | 2006305040 | 11/2006 |
| WO | 2004093588 | 11/2004 |

OTHER PUBLICATIONS

International Search Report and Written Opinion mailed Jan. 18, 2013 in International Application No. PCT/US2012/056996.

* cited by examiner

ATHLETIC FOOTWEAR WITH BALL CONTROL PORTIONS

BACKGROUND

The current embodiments relate generally to an article of footwear, and in particular to an article of footwear with ball control features.

Various types of articles of footwear have been previously proposed for use in a variety of applications. Sports participants, such as soccer players, may desire an article of footwear for improving ball control in a number of situations. Conventional articles of footwear directed towards soccer, however, include limited types of ball control features. For example, some conventional articles of footwear may only include provisions for enhancing one ball control function. Some conventional articles of footwear may only include provisions for gripping or passing the ball, for example.

SUMMARY

In one aspect, an article of footwear includes an upper having an outer surface. The article also includes a first ball control portion disposed on the outer surface of the upper and a second ball control portion disposed on the outer surface of the upper, where the first ball control portion is associated with a first type of kick and the second ball control portion is associated with a second type of kick that is different from the first type of kick. The first ball control portion includes a first gripping member and the second ball control portion includes a second gripping member. The first gripping member includes a first edge and the second gripping member includes a second edge, where the first edge is approximately aligned with the second edge.

In another aspect, an article of footwear includes an upper having an outer surface. The article also includes a first ball control portion disposed on the outer surface of the upper and a second ball control portion disposed on the outer surface of the upper, where the first ball control portion includes a first gripping member with a substantially elongated geometry and the second ball control portion including a second gripping member with a substantially compact geometry. The first gripping member is disposed adjacent to the second gripping member.

In another aspect, an article of footwear includes an upper having an outer surface and a sole structure. The upper also includes a toe portion and an opening configured to receive a foot. The article is associated with a first direction extending from the toe portion towards the opening and a second direction extending from a vamp portion of the upper towards the sole structure. A first group of gripping members disposed on the outer surface comprises a first ball control portion. A second group of gripping members disposed on the outer surface comprises a second ball control portion. The first group of gripping members is approximately aligned with the second group of gripping members with respect to the second direction. The height of the first ball control portion varies along the first direction.

In another aspect, an article of footwear includes an upper including an outer surface. The article also includes a first gripping member extending over the outer surface, where a portion of the first gripping member has a substantially smooth surface. The article also includes a second gripping member extending over the outer surface of the upper, where the second gripping member includes a plurality of protrusions. The first gripping member includes a first edge extending along a first length of the first gripping member and the second gripping member includes a second edge extending along a second length of the second gripping member. The first edge is substantially aligned with the second edge.

In another aspect, an article of footwear includes an upper including an outer surface. The article also includes a first gripping member extending over the outer surface, where the first gripping member has an approximately polygonal shape. The article also includes a second gripping member extending over the outer surface of the upper and disposed adjacent to the first gripping member. The article also includes a third gripping member extending over the outer surface of the upper, where the third gripping member includes a plurality of protrusions. The second gripping member extends between the first gripping member and the third gripping member. The first gripping member, the second gripping member and the third gripping member are approximately aligned.

In another aspect, an article of footwear includes a sole structure and an upper including an outer surface. The article also includes a first gripping member extending over the outer surface as well as a second gripping member extending over the outer surface of the upper and a third gripping member extending over the outer surface of the upper. The second gripping member extends between the first gripping member and the third gripping member. The first gripping member, the second gripping member and the third gripping member present an approximately continuous edge along the outer surface of the upper.

Other systems, methods, features and advantages of the current embodiments will be, or will become, apparent to one of ordinary skill in the art upon examination of the following figures and detailed description. It is intended that all such additional systems, methods, features and advantages be included within this description and this summary, be within the scope of the current embodiments, and be protected by the following claims.

BRIEF DESCRIPTION OF THE DRAWINGS

The current embodiments can be better understood with reference to the following drawings and description. The components in the figures are not necessarily to scale, emphasis instead being placed upon illustrating the principles of the current embodiments. Moreover, in the figures, like reference numerals designate corresponding parts throughout the different views.

DETAILED DESCRIPTION

The following discussion and accompanying figures disclose an article of footwear having an upper with one or more ball control portions. The article of footwear is disclosed as having a general configuration suitable for soccer. Concepts associated with the footwear may also be applied to a variety of other athletic footwear types, including, but not limited to: running shoes, baseball shoes, basketball shoes, cross-training shoes, cycling shoes, football shoes, golf shoes, tennis shoes, walking shoes, and hiking shoes and boots, for example. The concepts may also be applied to footwear types that are generally considered to be non-athletic, including dress shoes, loafers, sandals, and work boots. Accordingly, the concepts disclosed herein apply to a wide variety of footwear types.

Figure 1:
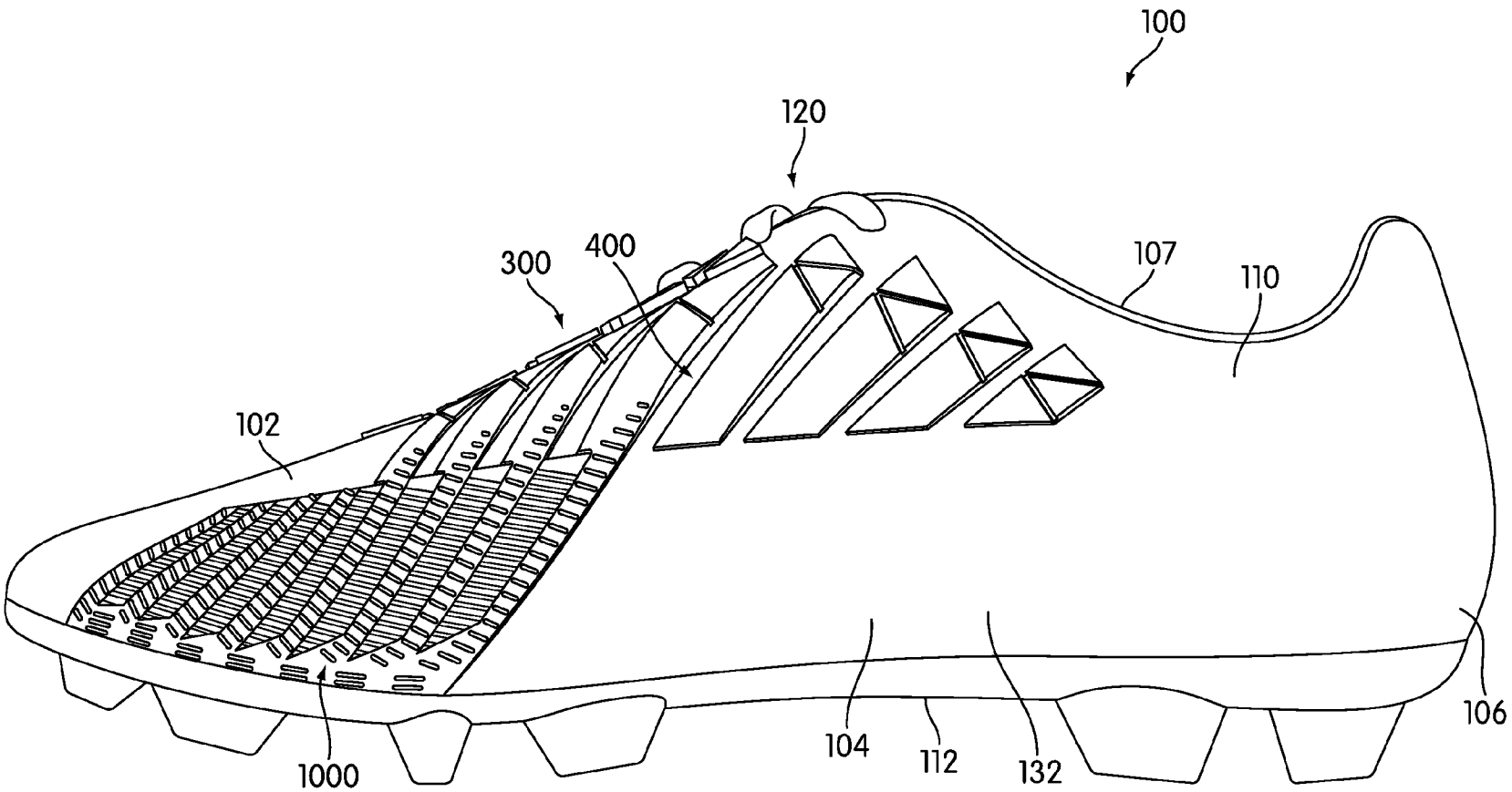
FIG. 1 is a side view of the medial side of one embodiment of an article of footwear.
Figure 2:
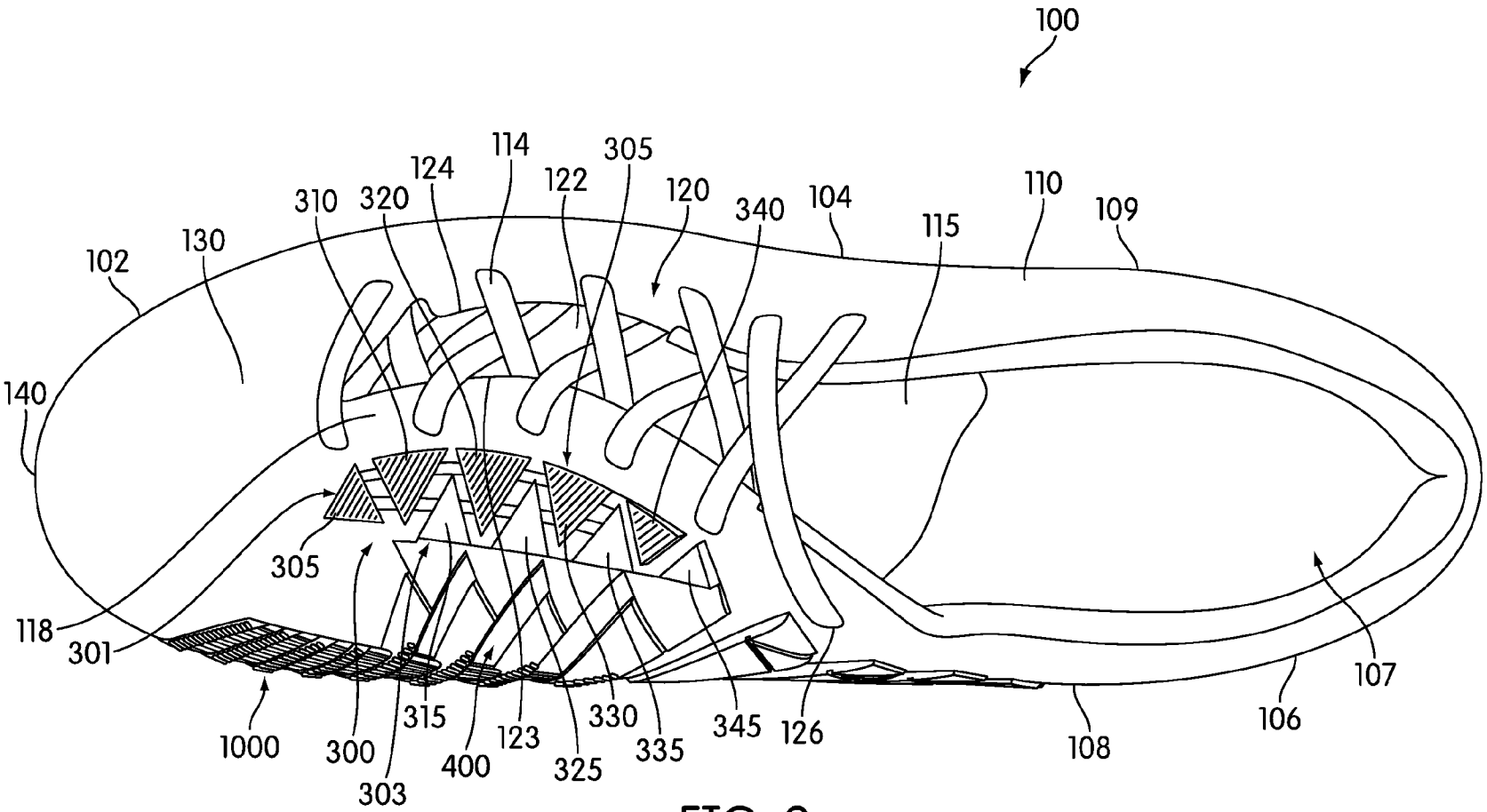
FIG. 2 is a top down view of one embodiment of an article of footwear.

FIGS. 1 and 2 illustrate an article of footwear 100 having an upper 110 and a sole structure 112. For reference purposes, article of footwear 100 may be divided into three general regions: a forefoot region 102, a midfoot region 104, and a heel region 106, as shown in FIGS. 1 and 2. Article of footwear 100 may also include a lateral side 109 and a medial side 108. Forefoot region 102 generally includes portions of article of footwear 100 corresponding with the toes and the joints connecting the metatarsals with the phalanges. Midfoot region 104 generally includes portions of footwear 100 corresponding with the arch area of the foot. Heel region 106 generally corresponds with rear portions of the foot, including the calcaneus bone. Medial side 108 and lateral side 109 extend from the forefoot region 102 through the midfoot region 104 and into the heel region 106. The forefoot region 102, midfoot region 104, and heel region 106, as well as the medial side 108 and lateral side 109, are not intended to demarcate precise areas of article of footwear 100. Rather, the forefoot region 102, midfoot region 104, and heel region 106, as well as the medial side 108 and lateral side 109, are intended to represent general areas of article of footwear 100 to aid in the following discussion. The forefoot region 102, midfoot region 104, and heel region 106, as well as the medial side 108 and lateral side 109, may be applied to upper 110, sole structure 112, and individual elements thereof in addition to the entire article of footwear 100. Although the embodiment of article of footwear 100 shown in the figures is for use with a right to a right foot, it will be understood that the same features and properties may also apply to an embodiment for the left foot.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole.

Sole structure 112 is secured to upper 110 and has a configuration that extends between upper 110 and the ground. In addition to attenuating ground reaction forces (i.e., cushioning the foot), sole structure 112 may provide traction, impart stability, and limit various foot motions, such as pronation. In some embodiments, the sole structure may include or form an outsole having ground-contacting elements and may be formed from a durable and wear-resistant material (e.g., rubber) that includes texturing to improve traction. Given that various aspects of the present discussion primarily relate to upper 110, sole structure 112 may exhibit the general configuration discussed above or the general configuration of practically any other conventional or non-conventional sole structure. Accordingly, the overall structure of sole structure 112 may vary significantly.

Upper 110 is depicted as having a substantially conventional configuration incorporating a plurality of material elements (e.g., textiles, polymer sheets, foam layers, leather, and synthetic leather). The material elements are stitched or adhesively bonded together to form an interior void for securely and comfortably receiving a foot. The material elements may be selected and located with respect to upper 110 to selectively impart properties of durability, air-permeability, wear-resistance, flexibility, and comfort, for example. A throat opening 107 in heel region 106 provides access to the interior void.

Some embodiments may include a fastening system to secure article 100 to the foot. Examples of a shoe fastening system include, but are not limited to, clasps, buttons, snaps, buckles, hooks, adhesives, hook and loop fasteners (such as Velcro), or any other structure known in the art. In addition, upper 110 may include a lacing system 120. Lacing system 120 may include lace 114 that is utilized in a conventional manner to modify the dimensions of the interior void, thereby securing the foot within the interior void and facilitating entry and removal of the foot from the interior void. In addition, a tongue portion 115 of upper 110 may extend between the interior void and lace 114.

In some embodiments, lacing system 120 may vary. In some cases, lacing system 120 may include a medial lacing edge 123 and a lateral lacing edge 124 that are separated by a lacing gap 122. In some embodiments, lacing gap 122 may extend from throat opening 107 of upper 110 towards forefoot region 102. In addition, lacing gap 122 may be associated with lacing holes 126 that are disposed on medial lacing edge 123 and lateral lacing edge 124. Furthermore, lace 114 may be disposed through lacing holes 126. With this arrangement, lace 114 may be used to tighten upper 110 around a foot.

In some embodiments, the shape of lacing gap 122 may vary. In some cases, lacing gap 122 may have a substantially straight shape. In other embodiments, lacing gap 122 may have a curved shape. In some embodiments, lacing gap 122 may be shaped to curve towards the lateral side 109. In other embodiments, lacing gap 122 may be shaped to curve towards the medial side 108. In some embodiments, lacing gap 122 may be arranged in an asymmetric manner on upper 110.

An article can include provisions for increasing a user's control over a ball during various athletic activities, such as soccer. In some embodiments, an article can include one or more ball control portions that facilitate improved shooting accuracy, passing and/or controlling the spin of a ball. Various kinds of ball control portions can provide different types of kicking assistance. For example, an article can include a ball control portion that helps facilitate low trajectories for a ball, which can be useful for shooting at a goal and/or for low passes. As another example, an article can include a ball control portion that helps with passing a ball. In still other cases, an article can include a ball control portion that helps improve shooting accuracy by enhancing the ability of a player to control the spin of the ball. In one embodiment, an article can include multiple different ball control portions, where each ball control portion is configured to provide targeted assistance for various types of kicks.

In some embodiments, upper 110 may be provided with one or more ball control portions. A ball control portion is any portion of an article that is configured to facilitate ball control through the use of various kinds of structures and/or patterns. Examples of different kinds of ball control structures can include, but are not limited to: gripping members, such as raised structures, strips or ridges; bumps, dimples or protrusions; structures with smooth surfaces, structures with rough surfaces as well as any other kinds of structures. In some cases, a ball control portion can comprise distinct ball control structures or members that share common features, such as geometry, material and/or other common features. In other cases, a ball control portion can comprise a collection of features that are located in a particular region of an article of footwear. Moreover, in some cases, ball control portions can be isolated, while in other cases, ball control portions could overlap and/or blend with one another.

In one embodiment, upper 110 may include three ball control portions including first ball control portion 300, second ball control portion 400 and third ball control portion 1000. Each different ball control portion can be configured to assist with different kinds of kicks. First ball control portion 300 may be configured to facilitate a first type of kick. Second ball control portion 400 may be configured to facilitate a second type of kick. Additionally, third ball control portion 1000 may be configured to facilitate a third type of kick. In some cases, the first type of kick, the second type of kick and the third type of kick may be substantially different kinds of kicks. For example, as described in further detail below, first ball control portion 300 may help facilitate a low trajectory for a ball. Likewise, second ball control portion 400 can help facilitate more accurate passing. Still further, third ball control portion 1000 may help control the amount and type of spin imparted to a ball during a kick. In other embodiments, the ball control portions could be configured to assist with any other kinds of kicks. Moreover, each ball control portion could provide assistance with two or more different kinds of kicks.

Figure 3:
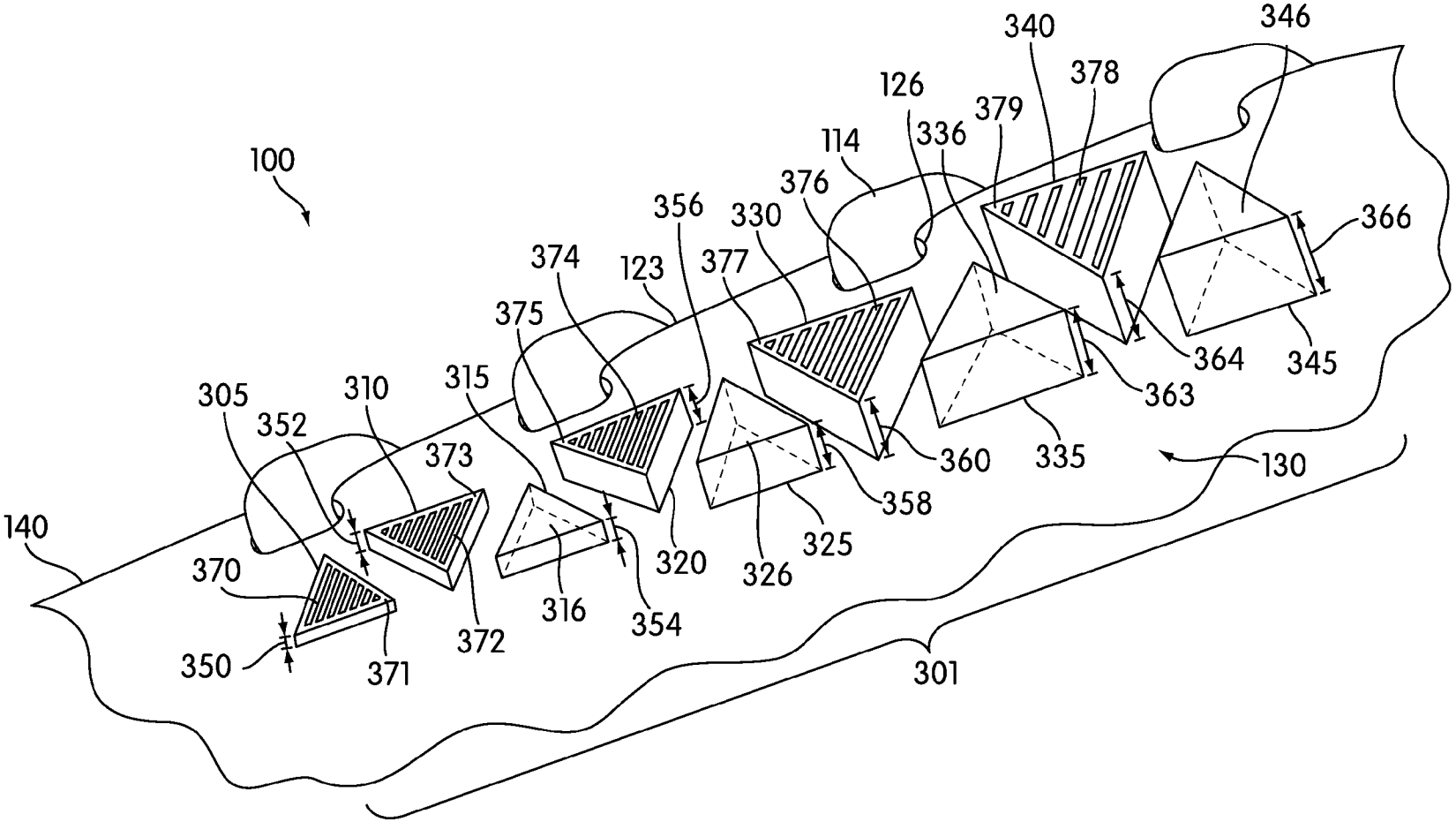
FIG. 3 is an enlarged perspective view of one embodiment of the upper surface on the medial side of an article of footwear having a low trajectory ball control portion.

One embodiment of a first ball control portion 300 is shown in FIGS. 2 and 3. As previously discussed, in some embodiments, first ball control portion 300 may be configured to lower the trajectory of a kicked ball. It will be understood, however, that the use of first ball control portion 300 may be adapted for other purposes as well in order to enhance control over a ball during passing, shooting, dribbling and/or other types of kicks or maneuvers.

The location of first ball control portion 300 on upper 110 may vary according to the intended purpose of first ball control portion 300. Generally, first ball control portion 300 may be located anywhere on outer surface 130 of upper 110. For example, first ball control portion 300 may be located in the forefoot region 102, midfoot region 104 and/or heel region 106. Some embodiments may include first ball control portion 300 along medial lacing edge 123 of vamp portion 118 of upper 110. Other embodiments, however, may include first ball control portion 300 on the medial side 108 and/or lateral side 109 of upper 110. Still other embodiments could include any other location for first ball control portion 300.

In some embodiments, first ball control portion 300 may include one or more gripping members disposed on outer surface 130 of upper 110. A gripping member is any structure or element that includes material and/or structural properties that facilitate increased grip or friction between upper 110 and a ball. In some cases, a single ball control portion can include one or more different types of gripping members. In other cases, different ball control portions may comprise different kinds of gripping members.

In some embodiments, first ball control portion 300 comprises first group of gripping members 301. First group of gripping members 301 may include first gripping member 305, second gripping member 310, third gripping member 315, fourth gripping member 320, fifth gripping member 325, sixth gripping member 330, seventh gripping member 335, eighth gripping member 340 and ninth gripping member 345. Although the current embodiment includes nine gripping members, in other embodiments first ball control portion 300 may include less than nine gripping members. In still other embodiments, first ball control portion 300 can include more than nine gripping members.

The shape of each gripping member making up first ball control portion 300 may vary. In some embodiments, the gripping members in first group 301 may be geometrically-shaped. In some cases, one or more gripping members can comprise a raised structure with an approximately geometric cross-sectional shape. Examples of different cross-sectional shapes include, but are not limited to: circles, triangles, squares, rectangles, diamonds, ovals, stars, ellipses, polygonal shapes, regular shapes, irregular shapes as well as any other shapes. In some cases, the cross-sectional size of a gripping member can vary, while in other cases the cross-sectional size of a gripping member can be substantially constant. In one embodiment, each gripping member of first group of gripping members 301 has the approximate geometry of a triangular prism. In particular, each gripping member has an approximately triangular cross-sectional shape that is substantially constant along the height of the gripping member.

Generally, the cross-sectional sizes of each gripping member comprising first ball control portion 300 can vary. In some cases, each gripping member can have a substantially similar cross-sectional size. In other cases, the cross-sectional sizes of two or more different gripping members can vary. In one embodiment, the cross-sectional size of each gripping member can selected in order to provide first ball control portion 300 with a predetermined surface area for contacting a ball.

In some embodiments, the arrangement of each gripping member within first ball control portion 300 may vary. For example, in some embodiments, the gripping members may be adjacent to one another. In some embodiments, the gripping members may have one or more portions that are connected to an adjacent ball control structure. In some embodiments, however, the gripping members may be spaced some distance from one another. In some embodiments, the distance between the ball control structures may be adjusted to optimize the effects of the ball control features.

In some embodiments, adjacent gripping members of first group of gripping members 301 may be oriented in an alternating manner. For example, in some cases, second gripping member 310, fourth gripping member 320, sixth gripping member 330 and eighth gripping member 340 are arranged in an interlocking configuration with first gripping member 305, third gripping member 315, fifth gripping member 325, seventh gripping member 335 and ninth gripping member 345. This arrangement provides an approximately continuous medial outer edge 303 and an approximately continuous lateral outer edge 305 for first ball control portion 300 (see FIG. 2).

In some embodiments, the relative height of each gripping member comprising first ball control portion 300 may vary. In some embodiments, the height of each gripping member may be substantially similar. In other embodiments, however, the height of each gripping member may not be substantially similar. In some embodiments, the height of each gripping member comprising first group of gripping member 301 may vary along a direction extending between toe portion 140 and opening 107. In some cases, this direction may be approximately along the longitudinal direction of article 100. In some cases, for example, the average height of the gripping members in forefoot region 102 may be smaller than the average height of the gripping members near throat opening 107. In some embodiments, the height of each gripping member may increase as the distance from the tip of the toe portion 140 increases.

In some embodiments, each gripping member making up first ball control portion 300 may increase in height as the distance from the tip of toe portion 140 increases. Referring to FIG. 3, first gripping member 305 may be the closest gripping member to the tip of the toe portion 140. In some embodiments, second gripping member 310 may be located further away from the tip of the toe portion 140 than first gripping member 305. First gripping member 305 may have a first height 350, while second gripping member 310 may have a second height 352. In some embodiments, second height 352 may be greater than first height 350.

The height of each remaining gripping member shown in FIG. 3 may continue to progressively increase as the distance from the tip of the toe portion 140 increases. Accordingly, third gripping member 315 may have a third height 354 that is greater than second height 352. Similarly, fourth gripping member 320 may have a fourth height 356 that is greater than third height 354. In addition, fifth gripping member 325 may have a fifth height 358 that is greater than fourth height 356. Additionally, sixth gripping member 330 may have a sixth height 360 that is greater than fifth height 358. Additionally, seventh gripping member 335 may have a seventh height 363 that is greater than sixth height 360. Additionally, eighth gripping member 340 may have an eighth height 364 that is greater than seventh height 363. Additionally, ninth gripping member 345 may have a ninth height 366 that is greater than eighth height 364.

Figure 4:
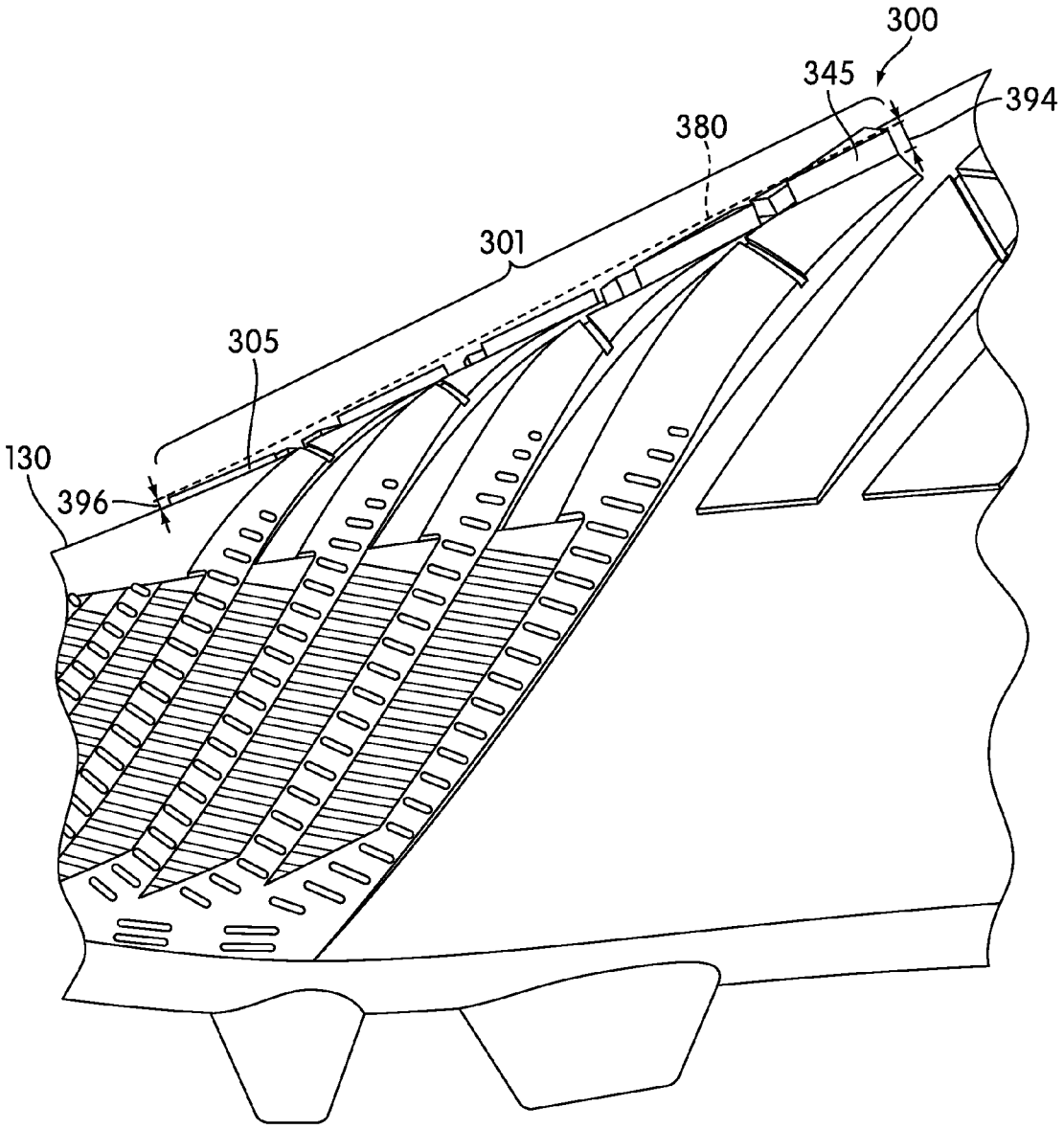
FIG. 4 is an enlarged perspective view of the medial side of one embodiment of a ball control portion located on the upper medial side of an article of footwear.

Referring now to FIG. 4, the varying heights of first group of gripping members 301 forms a kicking surface 380 for first ball control portion 300 that is inclined or sloped with respect to outer surface 130 of upper 110. This inclined kicking surface has a maximum height 394 and a minimum height 396 with respect to upper surface 130, corresponding to the heights of ninth gripping member 345 and first gripping member 305, respectively. By inclining the kicking surface presented by first ball control portion 300, a ball kicked using first ball control portion 300 may tend to have a lower trajectory than a ball kicked using a substantially flat surface that is approximately parallel with outer surface 130.

In some embodiments, the general shape of kicking surface 380 may vary. In some cases, the kicking surface 380 may be substantially flat. In other cases, kicking surface 380 may be curved. In some embodiments, kicking surface 380 may be convex in a lateral and/or longitudinal direction. In other cases, however, kicking surface 380 may be concave in a lateral and/or longitudinal direction so as to provide a more naturally contoured kicking surface. For example, some embodiments may include a kicking surface that is substantially concave in a longitudinal direction in a manner that corresponds to the natural curvature of the ball. Similarly, some embodiments may include a kicking surface that is substantially concave in a lateral direction in a manner that corresponds to the natural curvature of a ball. The approximate geometry of kicking surface 380 can be varied by adjusting the sizes, shapes, heights and/or arrangements of first group of gripping members 301 on outer surface 130.

Some embodiments of a ball control portion may include provisions for integrating one or more ball control features. In particular, some embodiments of a ball control portion may include provisions for increasing the friction between upper 110 and a ball in addition to lowering the trajectory of the ball. To increase friction between upper 110 and the ball, one or more of the structures making up the ball control portion may include textured surfaces. The textured surfaces may increase friction between upper 110 and the ball and may further enhance the ability of a player to guide the trajectory of the ball.

In some embodiments, one or more gripping members making up a ball control portion may have textured surfaces to increase friction between upper 110 and the ball. For example, in some embodiments, one or more gripping members may include at least one surface having recesses. In some embodiments, the recesses may form various shapes, such as squares, rectangles, circles, ovals, polygons, as well as irregular shapes. In some embodiments, the recesses may form grooves in a surface of one or more gripping members. In some embodiments, the recesses may cover only a portion of a surface of one or more gripping members. In other embodiments, the recesses may cover an entire surface of one or more gripping members. In some embodiments, one or more gripping members may have recesses, while other gripping members do not have recesses.

The recesses formed in the gripping members may be oriented in any manner. In some embodiments, the recesses may form grooves oriented substantially parallel to one another. In other embodiments, the recesses may form grooves oriented at an angle relative to one another. In some embodiments, the recesses may be formed in a non-uniform manner on a surface of a gripping member. In some embodiments, one or more recesses may be formed in only one surface of a gripping member. In some embodiments, however, one or more recesses may be formed in two or more surfaces of a gripping member. Some embodiments may include gripping members having recesses formed in a top surface. Other embodiments may include gripping members having recesses formed in one or more side surfaces.

The recesses may be formed by any manner known in the art. In some embodiments, the recesses may be formed during a molding process. More specifically, a mold for a gripping member may have protrusions that correspond to the recesses on the surface of the gripping member. In other embodiments, the recesses may be formed after a gripping member is formed. For example, the recesses may be cut or carved out of a surface of the gripping member. In other embodiments, the recesses may be formed by pressing a textured surface against the gripping member.

Referring to FIG. 3, one or more of the gripping members comprising ball control portion 300 may include recesses in at least one surface. For example, first gripping member 305 may have recesses 370 formed in top surface 371. Similarly, second gripping member 310 may have recesses 372 formed in top surface 373. Likewise, fourth gripping member 320 may have recesses 374 formed in top surface 375. In addition, sixth gripping member 330 may have recesses 376 formed in top surface 377. Additionally, eighth gripping member 340 may have recesses 378 formed in top surface 379. Although a total of five gripping members have a surface with recesses in the embodiment shown in FIG. 3, other embodiments may include more or less gripping members with recesses.

In the embodiment illustrated in FIG. 3, one or more of the ball control portions may include recesses, while other ball control portions may not include any recesses. As discussed above, some embodiments may include recesses in first gripping member 305, second gripping member 310, fourth gripping member 320, sixth gripping member 330, and eighth gripping member 340. Some gripping members, however, may not have recesses. For example, third gripping member 315 may have a smooth top surface 316. Similarly, top surface 326 of fifth gripping member 325, top surface 336 of seventh gripping member 335, and top surface 346 of ninth gripping member 345 may be smooth. This alternating configuration of smooth gripping members and recessed gripping members can help modify the traction properties first ball control portion 300.

Figure 5:
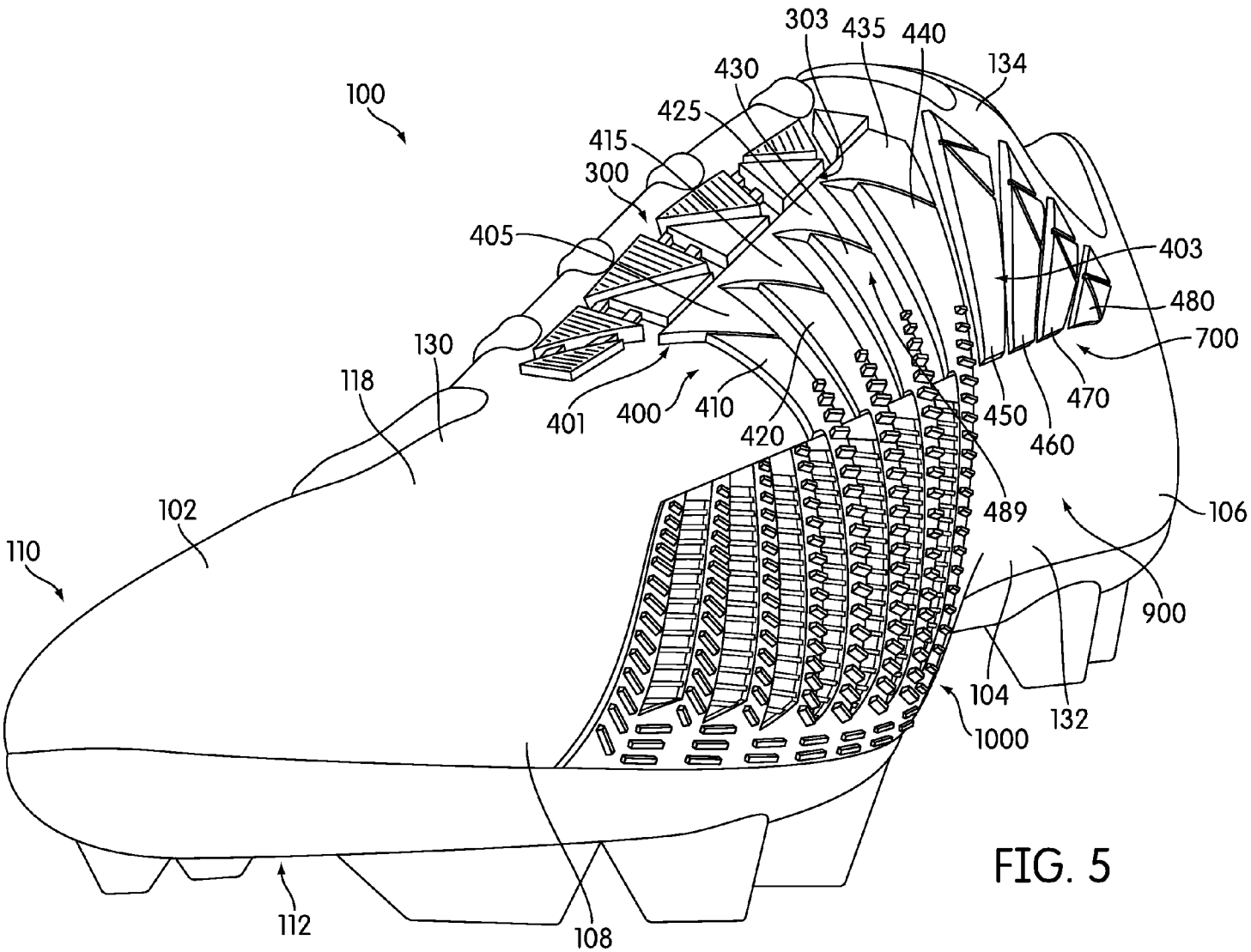
FIG. 5 is a perspective view of one embodiment of various ball control portions on an article of footwear.

Referring to FIG. 5, upper 110 can include second ball control portion 400. The location of second ball control portion 400 on upper 110 may vary according to the intended purpose of second ball control portion 400. Generally, second ball control portion 400 may be located anywhere on outer surface 130 of upper 110. For example, second ball control portion 400 may be located in the forefoot region 102, midfoot region 104 and/or heel region 106. Some embodiments may include second ball control portion 400 along medial side 108 of upper 110. Other embodiments, however, may include first ball control portion 300 on lateral side 109 of upper 110. In one embodiment, second ball control portion 400 may generally extend from forefoot region 102 through midfoot region 104 along medial side 108. In some cases, second ball control portion 400 may be disposed in the instep of upper 110.

In some cases, second ball control portion 400 can include second group of gripping members 401 and third group of gripping members 403. In some cases, second group of gripping members 401 can comprise gripping members that are substantially different in geometric shape and/or size than third group of gripping members 403. For example, in some cases, second group of gripping members 401 comprise first gripping member 405, second gripping member 415, third griping member 425 and fourth gripping member 435. Although the current embodiment of second group of gripping members 401 includes four gripping members, other embodiments could include less than four gripping members while still others could include more than four gripping members.

In some embodiments, the geometry of gripping members comprising second group of gripping members 401 could be similar to the geometry of the gripping members in first group of gripping members 301. For example, second group of gripping members 401 may comprise geometrically shaped members having an approximately triangular cross-sectional shape. In other cases, however, second group of gripping members 401 could have any other geometrical size and/or shape.

Third group of gripping members 403 may include first gripping member 410, second gripping member 420, third gripping member 430, fourth gripping member 440, fifth gripping member 450, sixth gripping member 460 seventh gripping member 470 and eighth gripping member 480. Although the current embodiment includes eight gripping members, other embodiments could include any other number of gripping members.

In some embodiments, the surface geometry of gripping members in third group of gripping members 403 could vary. For example, in some embodiments, the surfaces of the gripping members in third group of gripping members 403 could be substantially smooth. In other embodiments, the surfaces of the gripping members in the third group of gripping members 403 could have any kind of protrusions, recesses, dimples, or any other surface features. In still other embodiments, some gripping members of third group of gripping members 403 could be substantially smooth, while others could include surface features. In the embodiments shown in the Figures, at least some portions of the gripping members comprising third group of gripping members 403 are substantially smooth.

In some embodiments, the geometry of gripping members comprising third group of gripping members 403 could be substantially different from the geometry of second group of gripping members 401. In some cases, third group of gripping members 403 could comprise strips that have an elongated geometry. The term elongated geometry as used through this detailed description and in the claims refers to a geometry in which the length of a gripping member is substantially longer than the width and height of the gripping member. This elongated geometry may be in contrast to the approximately compact geometry of gripping members of second group of gripping members 401 as well as first group of gripping members 301. The term compact geometry refers to a geometry in which the length of a gripping member is not substantially greater than the width and height of the gripping member. In other embodiments, however, the geometry of one or more gripping members of third group of gripping members 403 may be similar to the geometry of one or more gripping members of first group of gripping members 301 and/or second group of gripping members 401.

In some embodiments, the gripping members of second ball control portion 400 may be arranged uniformly on upper 110. In other embodiments, the gripping members may be non-uniformly arranged. In one embodiment, second group of gripping members 401 may be aligned with medial edge 303 of first ball control portion 300. Also, in some cases, third group of gripping members 403 may be arranged in an approximately parallel manner on outer surface 130. In some embodiments, the third group of gripping members 403 may abut, or be in close proximity to, one another. In some embodiments, third group of gripping members 403 may be spaced to optimize the effects of the ball control features.

In some cases, the gripping members of second group of gripping members 401 and third group of gripping members 403 can be aligned in a manner that facilitates improved traction and ball control. In some cases, the spacing between gripping member 405 and gripping member 410 located in ball control portion 400 may vary. In some embodiments, gripping member 405 may be spaced some distance from gripping member 410 to optimize the effects of the ball control features. In some embodiments, however, a portion of gripping member 405 may be located adjacent to first gripping member 410. Similarly, second gripping member 415 may be located adjacent to second gripping member 420. In addition, gripping member 425 may be located adjacent to gripping member 430. Additionally, gripping member 435 may be located adjacent to gripping member 440. With this arrangement, second group of gripping members 401 may work in conjunction with third group of gripping members 403 as a single ball control portion 400.

In some embodiments, the height of one or more gripping members comprising second ball control portion 400 can vary. In some cases, for example, the height of some gripping members comprising second group of gripping members 401 could increase from medial edge 303 of ball control portion 300 towards medial side 108 of upper 110. Likewise, in some cases, the height of some gripping members comprising third group of gripping members 403 may decrease from second group of gripping members 401 towards medial side 108 of upper 110. This arrangement may provide a contoured kicking surface 489 that helps to facilitate passing and finesse kicks.

Figure 6:
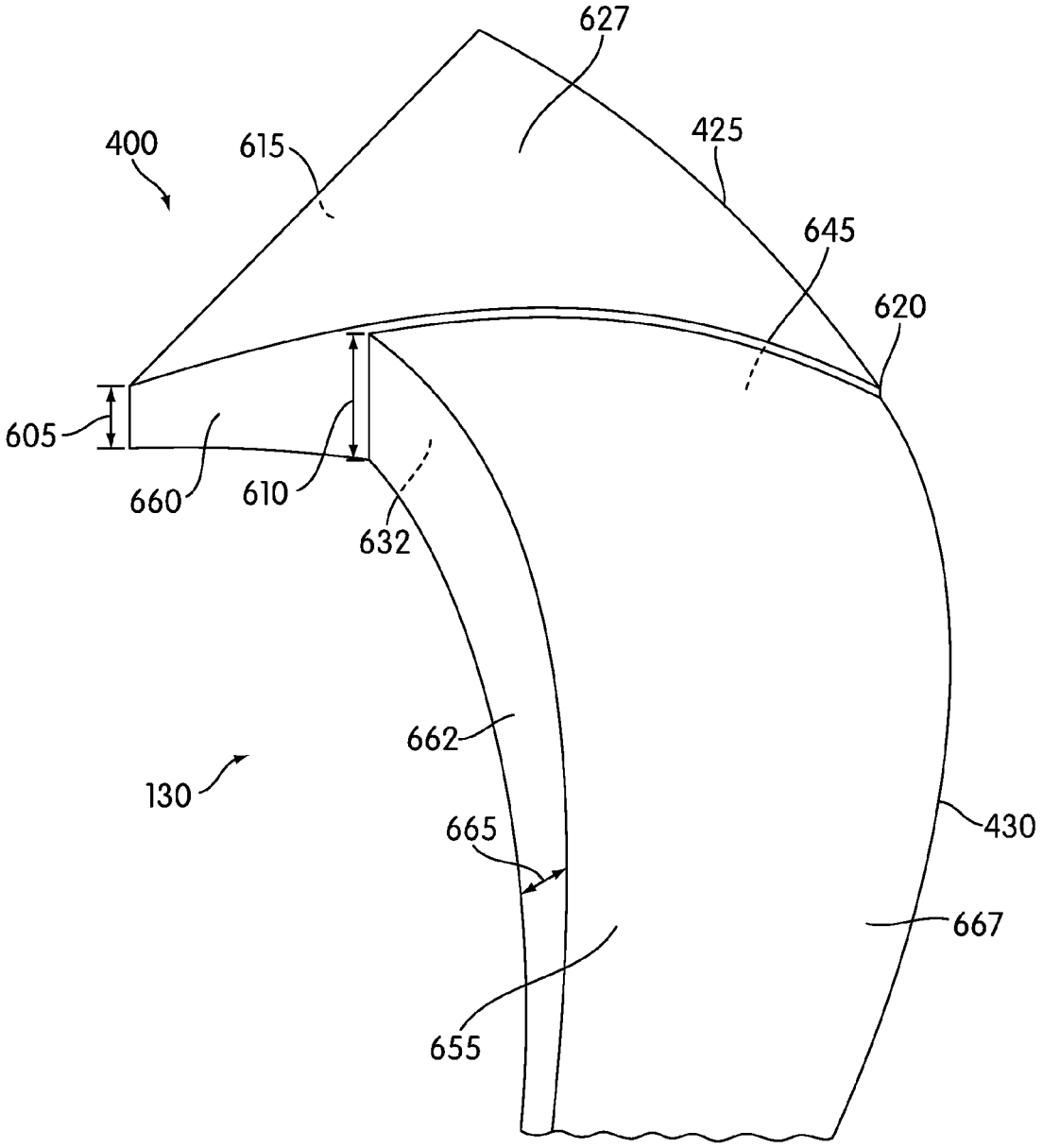
FIG. 6 is an enlarged view of one embodiment of two gripping members of a ball control portion.

FIG. 6 illustrates an enlarged view of gripping element 425 and gripping element 430 to illustrate the variation in height of these members. It will be understood that the remaining gripping members of second group of gripping members 401 and third group of gripping members 403 may have similar configurations.

The spacing between gripping member 425 and gripping member 430 shown in FIG. 6 may vary. In some embodiments, gripping member 425 may be disposed adjacent to gripping member 430. More specifically, a first surface 660 of gripping member 425 may be located adjacent to first surface 632 of gripping member 430. In some cases, gripping member 425 may be spaced apart from gripping member 430 to optimize the effects of the ball control features. In some embodiments, however, a portion of gripping member 425 may be in contact with gripping member 430.

Referring to FIG. 6, the height of gripping member 425 may vary. In some embodiments, the height of gripping member 425 may increase between side 615 and corner 620. For example, in some cases, gripping member 425 has a height 605 at side 615 and a height 610 at corner 620. Thus, in some cases, gripping member 425 may present an upwardly sloped surface 627 to a ball. In other cases, however, the height of gripping member 425 could decrease between side 615 and corner 620. Moreover, the height of gripping member 425 could vary in any other manner. In some cases, for example, the height of gripping member 425 could decrease between side 615 and corner 620. In still other cases, the height of gripping member 425 could be approximately constant.

The height of gripping member 430 can also vary. Referring to FIG. 6, the height of gripping member 430 could decrease between side 645 and intermediate portion 655. In some cases, gripping member 430 has a height 610 at side 645 and a height 665 at intermediate portion 655. Thus, in some cases, gripping member 430 may present a downwardly sloped surface 667 to a ball. In other cases, however, the height of gripping member 430 could vary in any other manner. In some cases, the height of gripping member 430 could increase between side 645 and intermediate portion 655. In still other cases, the height of gripping member 430 could be approximately constant.

The width of one or more gripping members comprising third group of gripping members 403 may also vary. In some embodiments, the width of gripping member 430 can vary. In some cases, the width of gripping member 430 may decrease from side 645 to intermediate portion 655. In other cases, the width of gripping member 430 could increase from side 645 to intermediate portion 655. In still other cases, the width of gripping member 430 could be approximately constant.

Using this arrangement, the geometries of gripping member 425 and gripping member 430 can be varied so that gripping member 425 and gripping member 430 present a substantially smooth contoured surface for a ball. In particular, the height of gripping member 425 and gripping member 430 are substantially similar at adjacent sides in order to prevent either gripping member from presenting a sharp edge to a ball during the use of second ball control portion 400 since sharp edges can alter the trajectory of a ball in undesired ways.

In a similar manner to gripping member 430, other gripping members of third group of gripping members 403 may have similar geometries that vary in height in a direction extending between vamp portion 118 (see FIG. 5) and sole structure 112. For example, in some cases, each of the gripping members in third group of gripping members 403 may have sloped geometries that taper in height towards sole structure 112. With this arrangement, third group of gripping members 403 may present a downwardly sloped surface to a ball, which may help lower the trajectory of a ball that is kicked using second ball control portion 400. In some other cases, some gripping members may have substantially constant heights.

Figure 7:
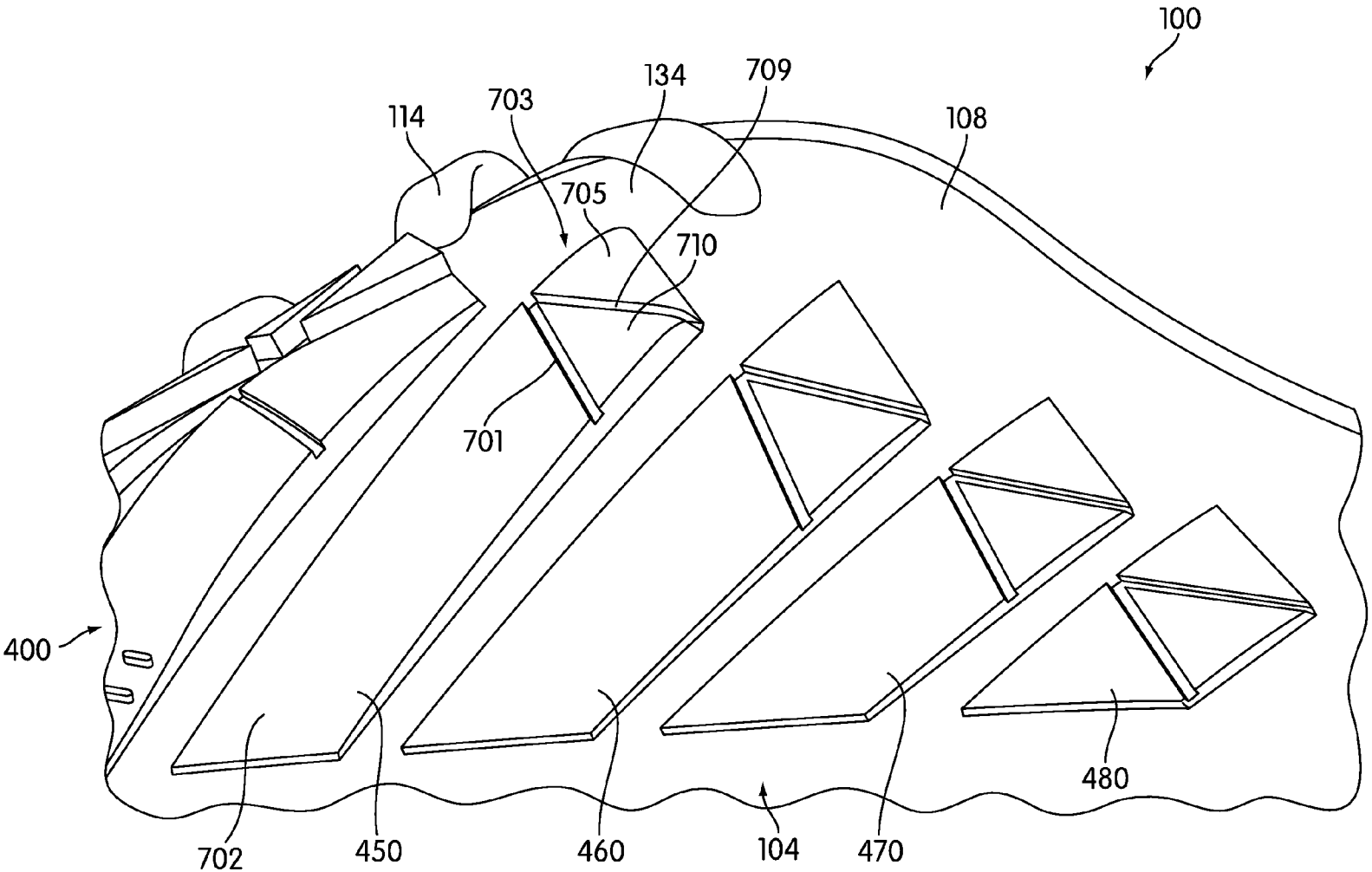
FIG. 7 is an enlarged side view of one embodiment of a ball control portion located on the upper medial side of an article of footwear.

FIG. 7 shows a close up view of various gripping members of ball control portion 400. In particular, gripping member 450, gripping member 460, gripping member 470 and gripping member 480 are shown in further detail. Referring to FIG. 7, gripping member 450, gripping member 460, gripping member 470 and gripping member 480 extend along medial side 108 in midfoot region 104.

In some cases, gripping member 450 can include first portion 702 and second portion 703. First portion 702 comprises a generally elongated portion, while second portion 703 has a substantially compact geometry. Moreover, first slot 701 is disposed between first portion 702 and second portion 703. Additionally, in some cases, second portion 703 is further divided into third portion 705 and fourth portion 710 by slot 709. In some cases, third portion 705 may be sloped or contoured. It will be understood that in some cases, the geometries of gripping member 460, gripping member 470 and gripping member 480 could be substantially similar to the geometry of gripping member 450. By varying the configurations of gripping member 450, gripping member 460, gripping member 470 and gripping member 480, the amount of traction applied to a ball during passing or finesse kicks can be varied.

Some embodiments may include a ball control portion having features that guide the trajectory of a kicked ball. Some embodiments may include ball control portions that impart spin on a ball when kicked.

FIGS. 8 through 11 illustrate various views of exemplary embodiments of third ball control portion 1000. Ball control portion 1000 may be located anywhere on the outer surface 130 of upper 110. In some embodiments, ball control portion 1000 may be located on a portion of upper 110 adjacent to sole structure 112. In some embodiments, ball control portion 1000 may be located in forefoot region 102, midfoot region 104, and/or heel region 106. In other embodiments, ball control portion 1000 may be in any other potion of upper 110.

Figure 8:
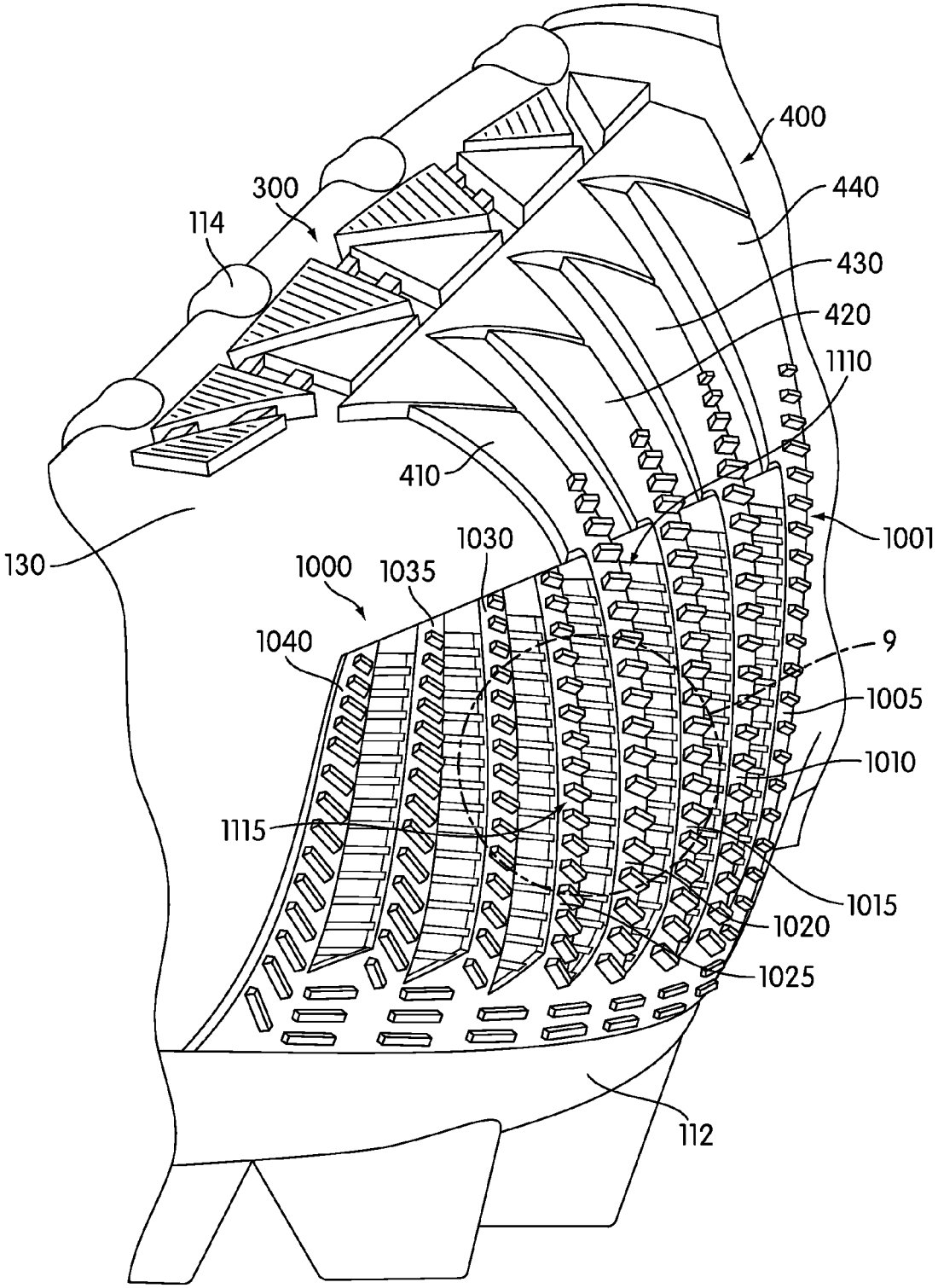
FIG. 8 is a perspective view of one embodiment of a ball control portion including a plurality of gripping members.

In some cases, third ball control portion 1000 can include fourth group of gripping members 1001. As seen in FIG. 8, fourth group of gripping members 1001 may include first gripping member 1005, second gripping member 1010, third gripping member 1015, fourth gripping member 1020, fifth gripping member 1025, sixth gripping member 1030, seventh gripping member 1035 and eighth gripping member 1040. Although FIG. 8 shows a total of eight gripping members in ball control portion 1000, other embodiments may include more or less gripping members.

In different embodiments, the geometry of gripping members comprising fourth group of gripping members 1001 can vary. In some cases, one or more gripping member could have a strip-like geometry. In other cases, one or more gripping members could have any other geometry including, but not limited to: triangular, rectangular, circular, polygonal, regular, irregular or any other geometry.

In some embodiments, gripping members comprising fourth group of gripping members 1001 may be arranged in any manner. In some cases, gripping members of fourth group of gripping members 1001 may be spaced some distance from one another. In some embodiments, gripping members 1001 may be arranged uniformly in ball control portion 1000. In some embodiments, gripping members 1001 may be substantially parallel to one another. In other embodiments, however, gripping members 1001 may be oriented at an angle to one another. In some embodiments, gripping members 1001 may generally extend in a direction from the forefoot region to the heel region. In other embodiments, gripping members 1001 may generally extend from an upper portion to a lower portion of the article of footwear 100.

Figure 9:
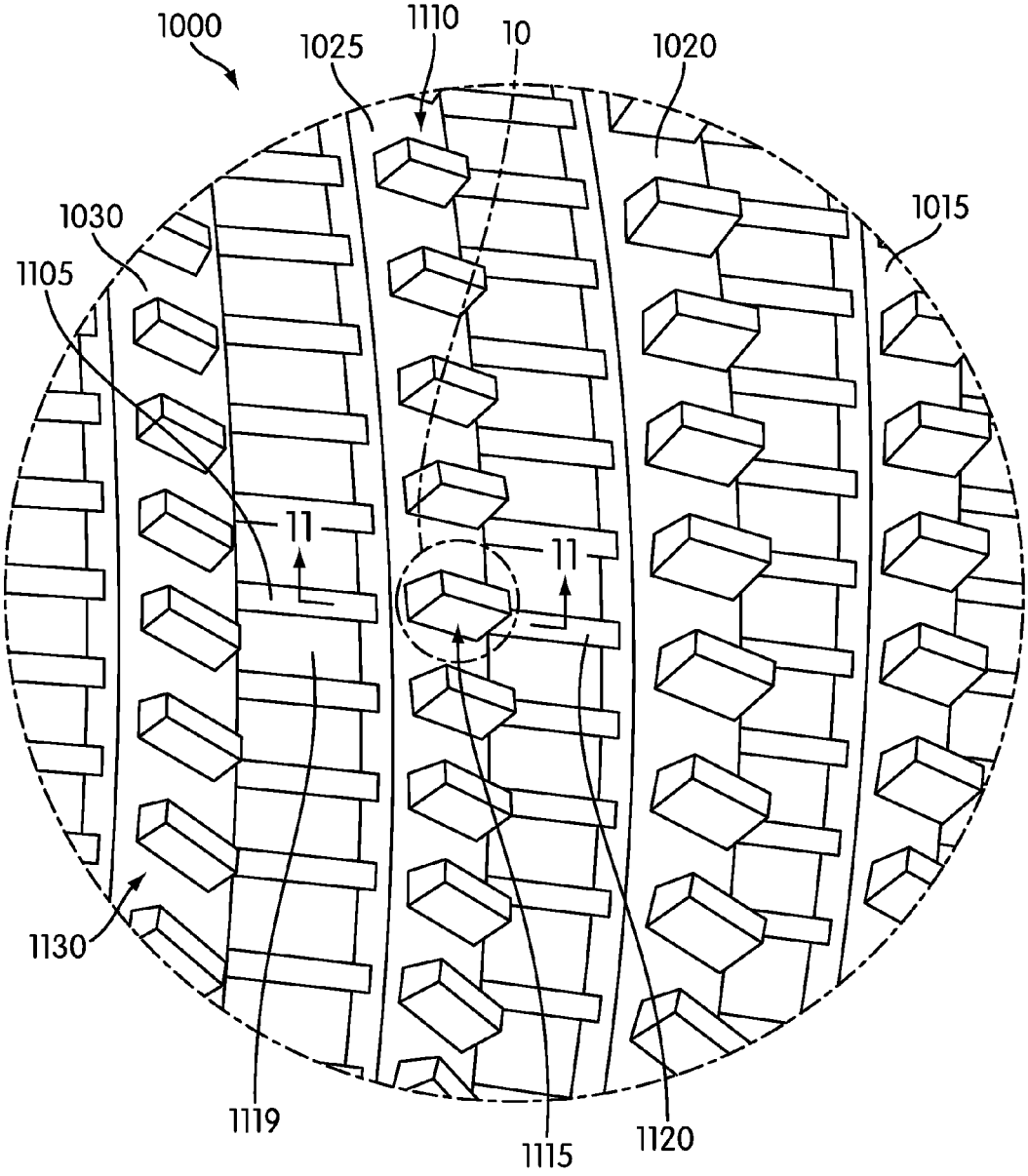
FIG. 9 is an enlarged view of one embodiment of a plurality of protrusions.
Figure 10:
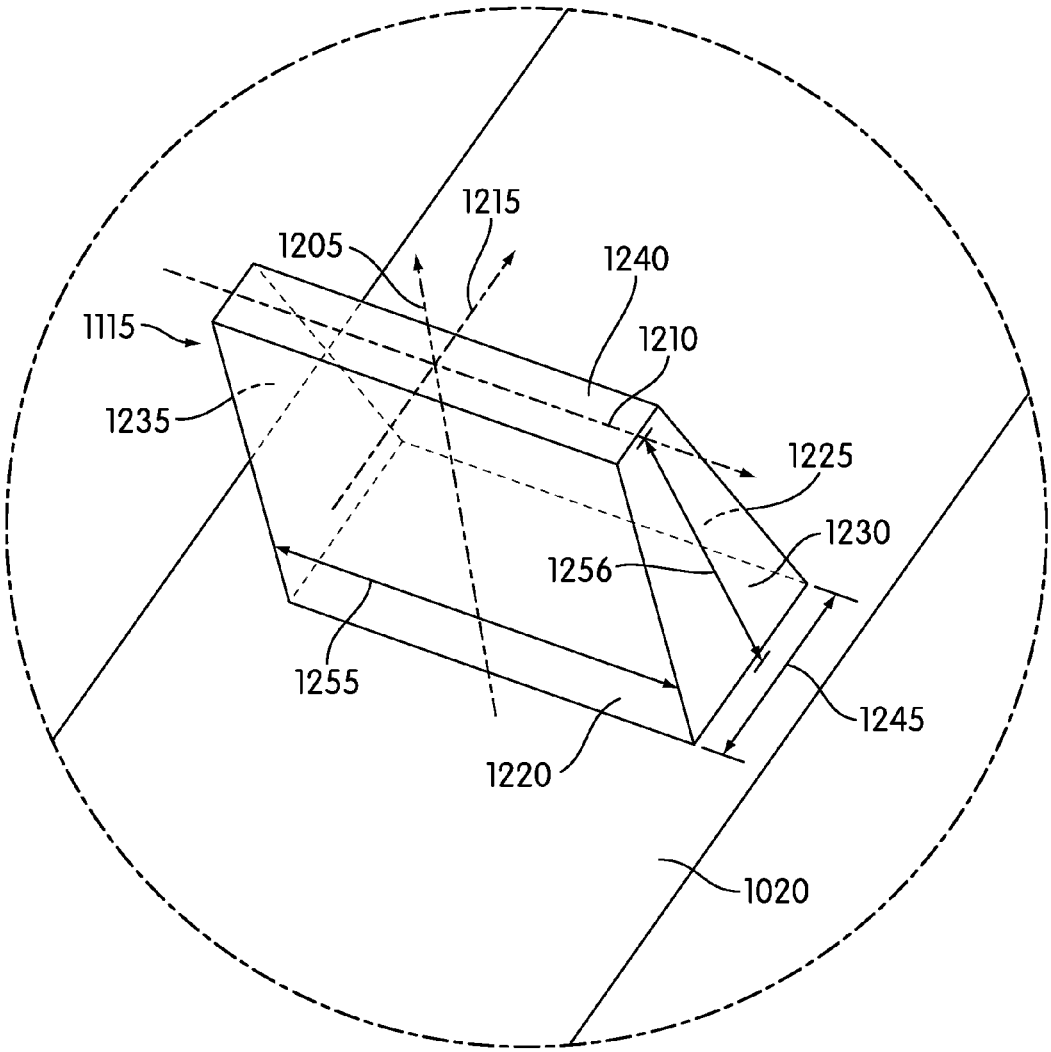
FIG. 10 is an enlarged perspective view of one embodiment of a protrusion.

In some embodiments, gripping members 1001 may be connected to one another by one or more connecting portions. FIG. 10 illustrates an isometric enlarged view of the ball control portion 1000 shown in FIG. 9. Referring to FIG. 10, a series of connecting portions, including first connecting portion 1105, may connect sixth gripping member 1030 to fifth gripping member 1025. Similarly, a series of connecting portions, including second connecting portion 1120, may connect fifth gripping member 1025 to fourth gripping member 1020. In some embodiments, a series of connecting portions may extend between each gripping member in ball control portion 1000.

In some embodiments, gaps may be created between the series of connecting portions. Referring to FIG. 9, gap 1119 may be created between connecting portions extending between fifth gripping member 1025 and sixth gripping member 1030. In some embodiments, gap 1119 may have a variety of shapes. In some cases, each gap may have a substantially similar shape. In other cases, one or more gaps may be shaped differently from one another. In some cases, gaps may be a rectangle or square. In other cases, however, gaps may be rounded, circular, elliptical, polygonal, or may form any other regular or irregular shape.

Some embodiments may include provisions for adjusting the weight of the article of footwear 100. For example, increasing the size of each gap may reduce the amount of material forming ball control portion 1000. Reducing the amount of material making up ball control portion 1000 may lower the overall weight of the article of footwear 100. Similarly, the size and shape of the gaps may be adjusted in order to reduce the amount of material forming ball control portion 1000.

Some embodiments may include provisions for adjusting the stiffness of article of footwear 100. For example, decreasing the size of each gap may increase the amount of material forming ball control portion 1000. Increasing the amount of material making up ball control portion 1000 may increase the rigidity of upper 110 in that region. Similarly, the size and shape of the gaps may be adjusted in order to increase the amount of material forming ball control portion 1000.

Some embodiments of ball control portion 1000 may include provisions for increasing the grip or friction between an upper and a ball. In one embodiment, ball control portion 1000 can include a plurality of protrusions 1110, as shown in FIGS. 8 and 9. Generally, plurality of protrusions 1110 can be any type of protrusions that extend outwards from outer surface 130 of upper 110. In different embodiments, plurality of protrusions 1110 can be configured in various ways. For example, in some cases, plurality of protrusions 1110 may be fin-like protrusions. In other cases, plurality of protrusions 1110 may be flap-like protrusions.

In some cases, protrusions may help improve traction with a ball by increasing the contacting surface area with a ball, as protrusions may be configured to bend and deform around the curvature of a ball. Protrusions can also help impart spin to a ball during a kick. Examples of ball control portions that include protrusions for enhancing traction and/or ball control are disclosed in Atsumi et al., previously U.S. Patent Publication Number 2010/0299967, published on Dec. 2, 2010, now U.S. Pat. No. 8,196,322, issued on Jun. 12, 2012, which is hereby incorporated by reference in its entirety.

One or more protrusions may be located anywhere on upper 110. In some embodiments, a plurality of protrusions may be associated with different ball control portions. For example, ball control portion 300, ball control portion 400 and ball control portion 1000 may each include one or more protrusions. One or more protrusions may be located on outer surface 130 of upper 110, or may extend from one or more structures forming a ball control portion. In FIGS. 8 and 9, for example, ball control portion 1000 includes plurality of protrusions 1110 disposed on one or more gripping members. However, one or more protrusions may also extend from outer surface 130 of upper 110.

For purposes of characterizing the size, geometry and/or orientation of a protrusion, each protrusion discussed in this detailed description and in the claims may be associated with a set of axes that are defined relative to each protrusion. The term "major axis" as used throughout this detailed description and in the claims refers to an axis extending through a length of a protrusion. The term "minor axis" as used throughout this detailed description and in the claims refers to an axis extending through a width of a protrusion. Furthermore, the term "normal axis" as used throughout this detailed specification and in the claims refers to a direction extending through a height of the protrusion, that is generally perpendicular (or normal) to a plane formed between the major axis and the minor axis. It should be understood that these axes are defined locally with respect to an individual protrusion so that a major axis of one protrusion may not be coincident with a major axis of another protrusion.

FIG. 10 illustrates an isolated view of a first protrusion 1115 for purposes of illustrating the geometry of plurality of protrusions 1110. Although FIG. 10 illustrates first protrusion 1115 in ball control portion 1000, the features and properties discussed in FIG. 10 may apply to protrusions in any ball control portion, including ball control portion 1000. Referring to FIG. 10, for purposes of description, first protrusion 1115 may be associated with major axis 1210, minor axis 1215, and normal axis 1205 in the manner described above. In some cases, first protrusion 1115 includes a first gripping portion 1220 and a second gripping portion 1225, that is opposite of first gripping portion 1220. First gripping portion 1220 and second gripping portion 1225 may form sidewalls for first protrusion 1115. In particular, first gripping portion 1220 and second gripping portion 1225 may be approximately planar surfaces that extend substantially along the direction of major axis 1210 and normal axis 1205. In other embodiments, however, first gripping portion 1220 and second gripping portion 1225 may be curved surfaces.

In some embodiments, first protrusion 1115 may include additional surfaces. First protrusion 1115 can also include first side 1230 and second side 1235 that may extend in the direction of minor axis 1215 and normal axis 1205. In some cases, the first side 1230 and second side 1235 can be approximately planar surfaces. In other cases, first side 1230 and second side 1235 can be approximately rounded edges. In addition, first protrusion 1115 can include top surface 1240 that may extend in the direction of major axis 1210 and minor axis 1215. In some cases, top surface 1240 may be an approximately planar top surface that presents a flat end for first protrusion 1115. In other cases, however, top surface 1240 may be a rounded surface.

In some embodiments, the dimensions of first protrusion 1115 may vary. In some embodiments, length 1255 of first protrusion 1115 may be associated with major axis 1210. In some embodiments, width 1245 may be associated with minor axis 1215. Likewise, height 1256 of first protrusion 1115 may be associated with normal axis 1205. It will also be understood that in some cases, the length, width and or height could vary. For example, width 1245 may vary along normal axis 1205. In other words, width 1245 may vary between the bottom and top of protrusion 1115.

In one embodiment, length 1255 and height 1256 could be substantially larger than width 1245. With this arrangement for the dimensions of first protrusion 1115, first gripping portion 1220 and second gripping portion 1225 may include a majority of the surface area of first protrusion 1115. In other embodiments, however, the relative sizes of length 1255, height 1256 and width 1245 could vary in any other manner.

In some embodiments, first protrusion 1115 may be configured to bend. In some cases, first protrusion 1115 may be configured to bend about an axis approximately parallel to major axis 1210. In other words, first protrusion 1115 may be configured to bend in a manner that disposes either first gripping portion 1220 or second gripping portion 1225 closer to outer surface 130 of upper 110. For example, in one direction of bending, second gripping portion 1225 may approximately confront fourth gripping member 1020. Furthermore, in this case, first gripping portion 1220 may be oriented to face outwardly and away from upper 110. In a second direction of bending, first gripping portion 1220 may approximately confront fourth gripping member 1020. Furthermore, in this case, second gripping portion 1225 may be oriented to face outwardly and away from upper 110. With this arrangement, as first protrusion 1115 bends, either first gripping portion 1220 or second gripping portion 1225 are exposed outwardly on outer surface 130 of upper 110. This arrangement can increase the surface area of first protrusion 1115 that is exposed outwardly on upper 110. Increasing the surface area can help increase grip on a ball during kicks, for example.

It will be understood that the discussion above for first protrusion 1115 may be applied to any protrusion located in any ball control portion. The general geometry of each protrusion may be substantially similar to the geometry described for first protrusion 1115. In addition, each protrusion may be provided with at least one gripping portion that is configured to contact the ball. Furthermore, each protrusion may be configured to bend in a similar manner about a major axis of the protrusion so as to expose a gripping portion outwardly on upper 110.

Referring back to FIG. 9, in some embodiments, the orientation of one or more protrusions could vary. In some cases, protrusions could be oriented in a longitudinal direction along outer surface 130 of upper 110. In other cases, protrusions could be oriented in a lateral direction along outer surface 130 of upper 110. In still other cases, protrusions could be oriented in a direction between a lateral and longitudinal direction along outer surface 130. Moreover, in some cases, the orientation of each protrusions could vary along ball control portion 1000. For example, referring to FIGS. 8 and 9, the orientations of plurality of protrusions 1110 may vary over different regions of ball control portion 1000.

Some embodiments of ball control portion 1000 may include further provisions for gripping. For example, some embodiments may include provisions for increasing the gripping effectiveness of ball control portion 1000 as the impact force from the ball increases. For example, in some embodiments, the components making up ball control portion 1000 may deform or compress upon impact of the ball. By staggering the height of various components making up ball control portion 1000, the components extending the least distance from the surface of upper 110 may not engage the surface of the ball unless the force of the ball compresses or deforms the components extending further from the surface of upper 110. Such an arrangement would provide less impact surface area of ball control portion 1000 for gripping the ball when impact forces are low, and more impact surface area of ball control portion 1000 for gripping the ball when impact forces are high.

Figure 11:
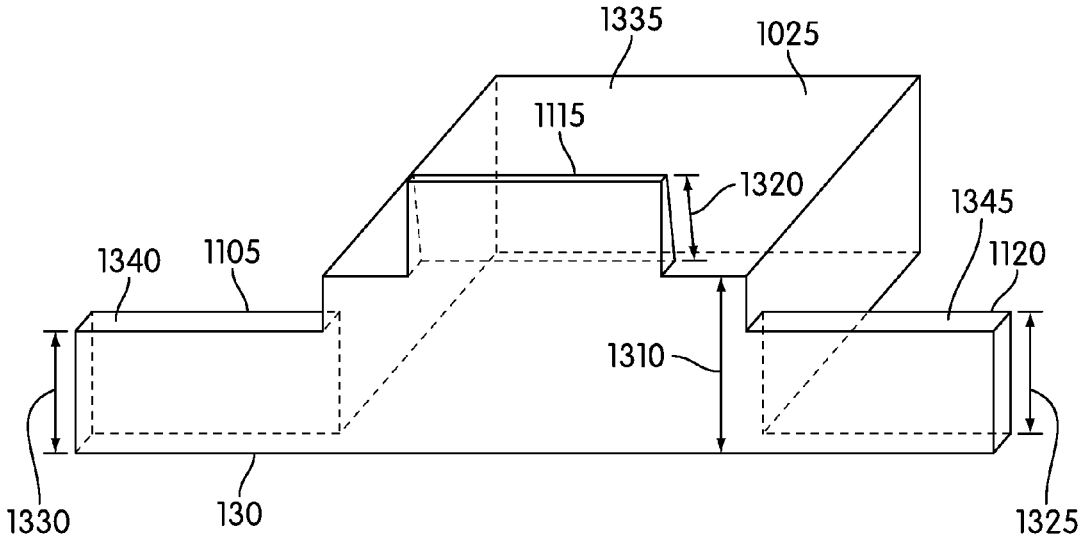
FIG. 11 is an enlarged perspective view of a portion of a ball control portion with protrusions.

In some embodiments, the height of each component in ball control portion 1000 may vary. FIG. 11 illustrates a cross-sectional view of ball control portion 1000 as indicated in FIG. 9. Referring to FIG. 11, first protrusion 1115 may extend first distance 1320 from fifth gripping member 1025. Fifth gripping member 1025 may extend second distance 1310 from outer surface 130 of upper 110. First connecting portion 1105 may extend third distance 1330 from outer surface 130 of upper 110, and second connecting portion 1120 may extend fourth distance 1325 from outer surface 130 of upper 110.

In some embodiments, the relative heights of the components in ball control portion 1000 may vary to provide an appropriate amount of impact surface area based on the impact force of the ball. In some embodiments, the relative heights between the gripping members and the connecting portions may vary. In some embodiments, the connecting portions may extend further from outer surface 130 of upper 110 than the gripping members. In such an embodiment, second distance 1310 may be less than third distance 1330. In addition, second distance 1310 may be less than fourth distance 1325. In such an arrangement, if the impact force of the ball is such that first protrusion 1115 bends or deforms a first distance 1320, then the ball may next engage top surface 1340 of first connection portion 1105 and/or top surface 1345 of second connecting portion 1120.

In other embodiments, the connecting portions may extend substantially the same distance from outer surface 130 of upper 110 as the gripping members. In such an embodiment, second distance 1310 may be substantially equal to third distance 1330, as well as fourth distance 1325. In such an arrangement, if the impact force of the ball is such that first protrusion 1115 bends or deforms a first distance 1320, then the ball may next simultaneously engage top surface 1335 of fifth gripping member 1025, top surface 1340 of first connecting portion 1105, and top surface 1345 of second connecting portion 1120.

In some embodiments, the gripping member may extend further than the connection portions. Referring to FIG. 11, fifth gripping member 1025 may extend a further distance from outer surface 130 of upper 110 than first connecting portion 1105 and second connecting portion 1120. In such an arrangement, if the impact force of the ball is such that first protrusion 1115 bends or deforms a first distance 1320, then the ball may next engage top surface 1335 of fifth gripping member 1025.

An article can include provisions to help prevent a ball from contacting corners that may affect the trajectory of a ball in an undesired manner. In articles with multiple different ball control portions, the gripping members of the ball control portions can be arranged to help blend the ball control portions in a smooth manner.

Figure 12:
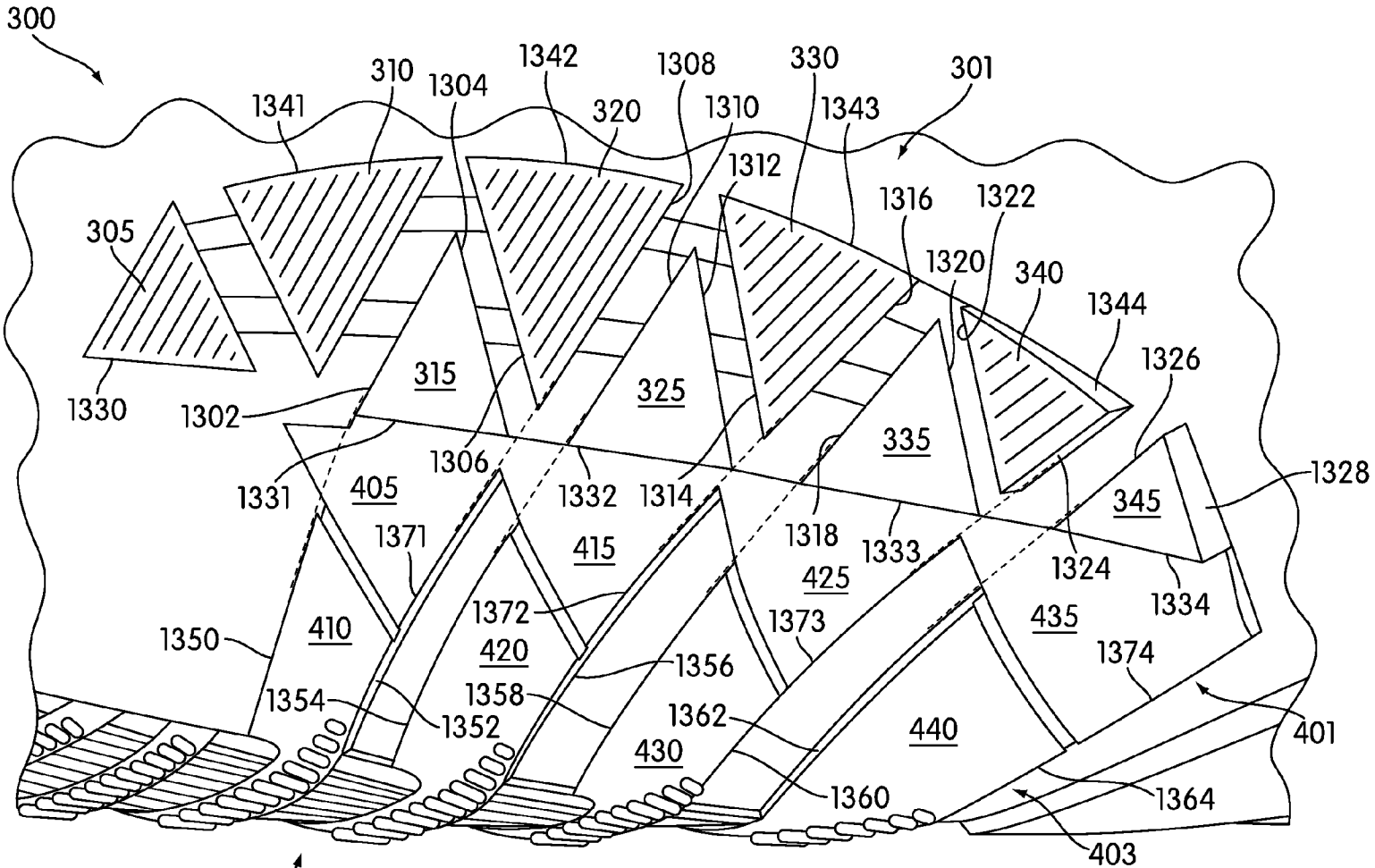
FIG. 12 is an enlarged top down view of one embodiment of an article of footwear.

FIG. 12 illustrates a top down enlarged view of upper 110, including first ball control portion 300 and second ball control portion 400. Referring to FIG. 12, some gripping members of first group of gripping members 301 may be approximately aligned with some gripping members of second group of gripping members 403.

For purposes of describing the alignment of various different gripping members, the geometries of some gripping members are described in further detail. Each gripping member comprises a forward most edge and a rearward most edge. For example, gripping member 315 includes forward most edge 1302 and rearward most edge 1304. Likewise, edge 1306, edge 1310, edge 1314, edge 1318, edge 1322 and edge 1326 are the forward most edges of gripping member 320, gripping member 325, gripping member 330, gripping member 335, gripping member 340 and gripping member 345, respectively. Also, edge 1308, edge 1312, edge 1316, edge 1320, edge 1324 and edge 1328 are the rearward most edges of gripping member 320, gripping member 325, gripping member 330, gripping member 335, gripping member 340 and gripping member 345, respectively. Moreover, edge 1341, edge 1342, edge 1343 and edge 1344 of gripping member 310, gripping member 320, gripping member 330, and gripping member 340, respectively, are aligned in an approximately longitudinal direction along upper 110. Likewise, edge 1330, edge 1331, edge 1332, edge 1333 and edge 1334 of gripping member 315, gripping member 325, gripping member 335 and gripping member 345, respectively, are aligned in an approximately longitudinal direction along upper 110.

In some cases, gripping member 410 includes forward most edge 1350 and rearward most edge 1352. Likewise, gripping member 420, gripping member 430 and gripping member 440 include forward most edge 1354, edge 1358 and edge 1362, respectively. Additionally, gripping member 420, gripping member 430 and gripping member 440 include rearward most edge 1356, edge 1360 and edge 1364.

In order to reduce the number of corners presented by one or more ball control portions, one or more gripping members could be aligned to present substantially continuous edges along an upper. In some cases, edge 1302 of gripping member 315 may be approximately aligned with edge 1350 of gripping member 410. Also, edge 1310 of gripping member 325 may be approximately aligned with edge 1354 of gripping member 420. In addition, edge 1318 of gripping member 335 may be approximately aligned with edge 1358 of gripping member 430. Moreover, edge 1326 of gripping member 345 may be approximately aligned with edge 1362 of gripping member 440. In some cases, edge 1308 of gripping member 320 may be approximately aligned with edge 1352 of gripping member 410. Also, edge 1316 of gripping member 330 may be approximately aligned with edge 1356 of gripping member 420. In addition, edge 1324 of gripping member 340 may be approximately aligned with edge 1360 of gripping member 440.

In some cases, gripping members of second group of gripping members 401 could also be aligned with gripping members of first group of gripping members 301 and/or third group of gripping members 403. For example, in some cases, edge 1371 of gripping member 405 may be approximately aligned with edge 1308 and edge 1352. Also, edge 1372 of gripping member 415 may be approximately aligned with edge 1316 and edge 1356. Also, edge 1373 of gripping member 425 may be approximately aligned with edge 1324 and edge 1360. Finally, in some cases, edge 1374 of gripping member 435 may be approximately aligned with edge 1364 of gripping member 440.

With this arrangement, first group of gripping members 401, second group of gripping members 401 and third group of gripping members 403 may be aligned to present substantially continuous edges along upper 110 at ball control portion 300 and ball control portion 400. This helps to facilitate smoother ball control by reducing the tendency of a ball to deflect in an undesired manner off of corners or discontinuous portions of an upper. Moreover, this configuration provides a blended arrangement for first ball control portion 300 and second ball control portion 400 that allows for a smooth transition between first ball control portion 300 and second ball control portion 400.

Figure 13:
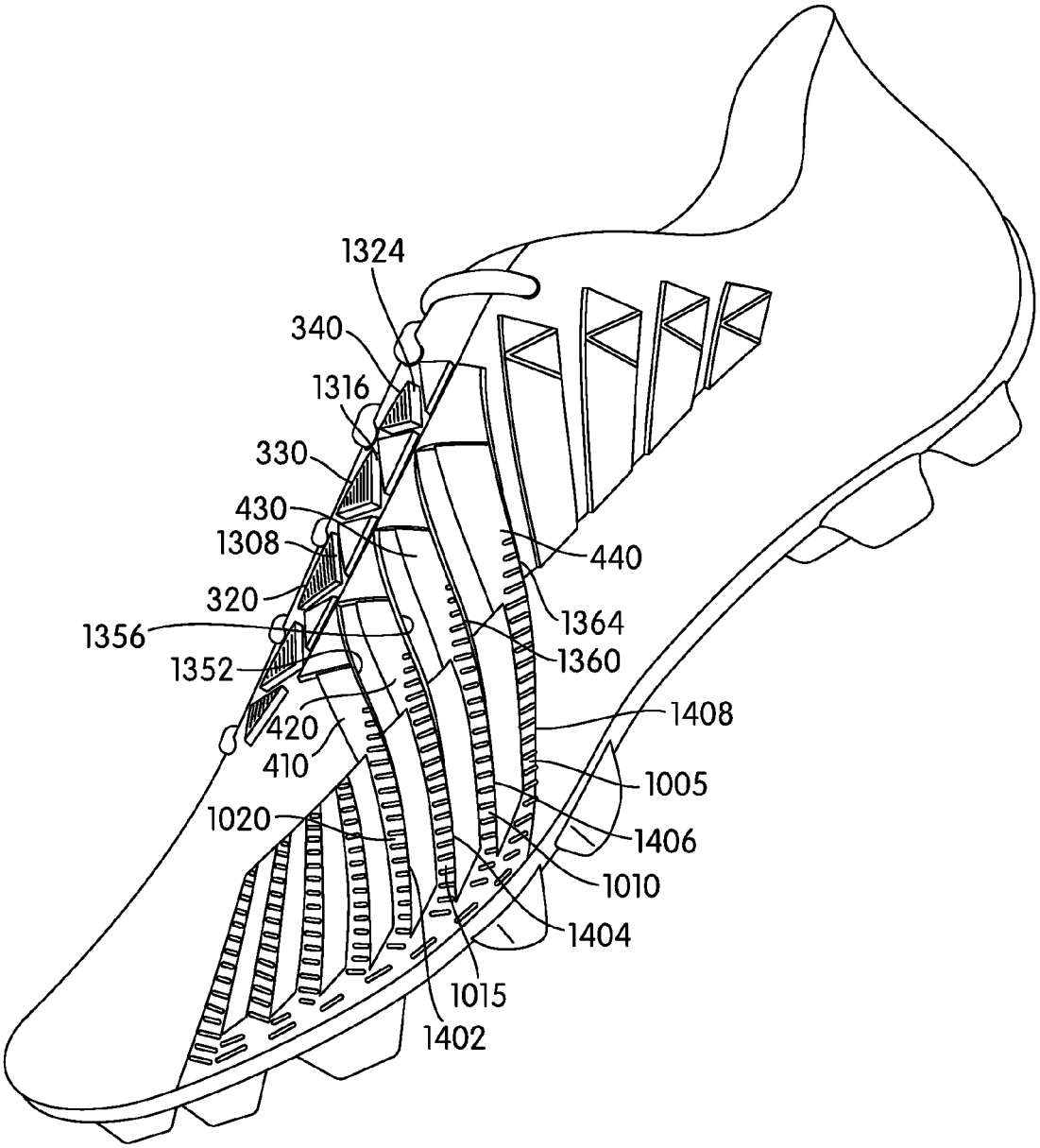
FIG. 13 is side view of one embodiment of an article of footwear with various ball control portions.

In some embodiments, gripping members of second ball control portion 400 and third ball control portion 1000 can also be arranged in a manner that reduces corners and provides substantially continuous edges. Referring to FIG. 13, in some cases, some gripping members of fourth group of gripping members 1001 can be aligned with gripping members of first group of gripping members 401 and/or gripping members of second group of gripping members 403. For example, in the current embodiment, edge 1402 of gripping member 1020 may be approximately aligned with edge 1352 and edge 1308 of gripping member 410 and gripping member 320, respectively. Also, edge 1404 of griping member 1015 is approximately aligned with edge 1356 and edge 1316 of gripping member 420 and gripping member 330, respectively. Additionally, edge 1406 of gripping member 1010 is approximately aligned with edge 1360 and edge 1324 of gripping member 430 and gripping member 340, respectively. In some cases, edge 1408 of gripping member 1005 may also be approximately aligned with edge 1364 of gripping member 440.

In some embodiments gripping member 410, gripping member 420, gripping member 430 and gripping member 440 may be continuously formed with gripping member 1020, gripping member 1015, gripping member 1010 and gripping member 1005, respectively. In other embodiments, however, one or more of the gripping members from third group of gripping member 403 may be separated or spaced apart from gripping members of fourth group of gripping members 1001. Moreover, in some cases, the width of each gripping member in fourth group of gripping members 1001 may be substantially less than the width of each gripping member in third group of gripping members 403. In other cases, however, the widths of gripping members in fourth group of gripping members 1001 could be greater than or equal to the widths of gripping members in third group of gripping members 403.

This configuration can help provide substantially continuous edges throughout first ball control portion 300, second ball control portion 400 and third ball control portion 1000. This helps to provide a smooth transition between each different ball control portion, each of which comprise gripping members of different geometries and/or different configurations.

Figure 14:
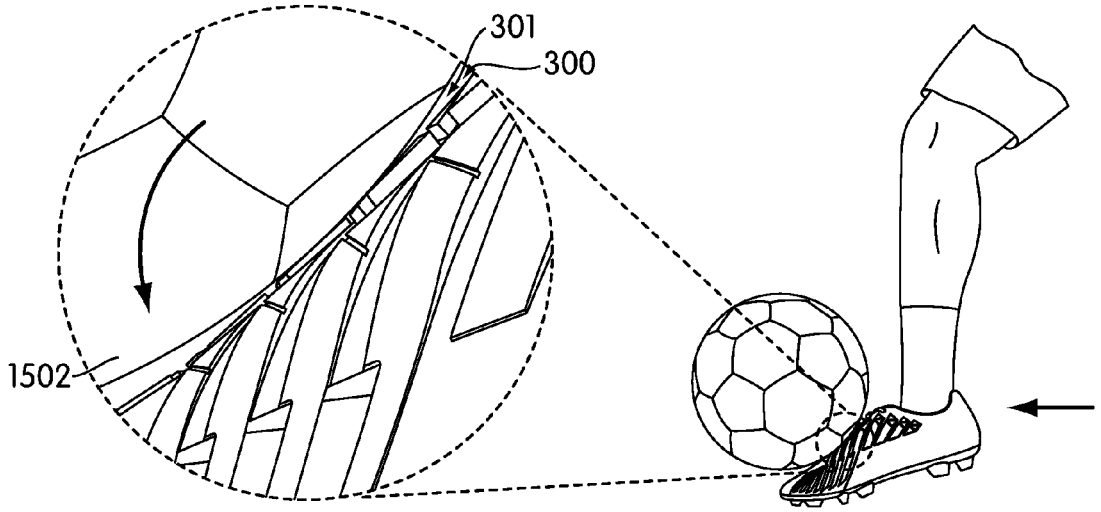
FIG. 14 is a view of one embodiment of a player using a ball control portion to maintain a low trajectory for a kicked ball.

FIGS. 14 through 18 illustrate embodiments of various situations in which one or more ball control portions can be used to provide targeted ball control for different situations. FIG. 14 illustrates an embodiment where a user is kicking ball 1502 using first ball control portion 300. In this case, the inclined surface presented by first group of gripping members 301 helps to urge ball 1502 downwards. Therefore, first ball control portion 300 not only enhances traction with ball 1502 but also helps to keep the trajectory of ball 1502 low. For users playing soccer, this arrangement can help keep a ball low during a shot on goal to prevent the ball from rising over the crossbar of the goal.

Figure 15:
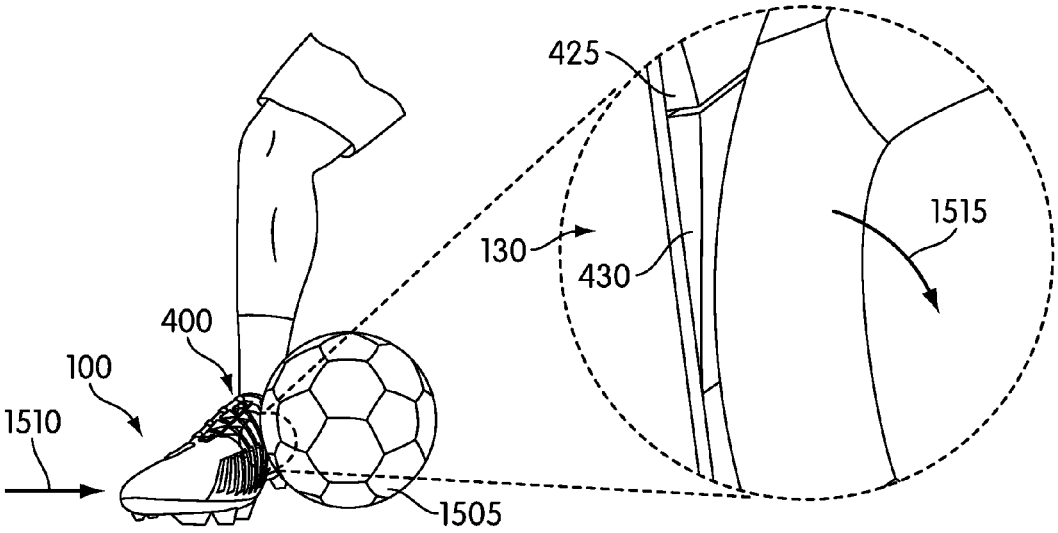
FIG. 15 is a view of one embodiment of a player using a ball control portion on a medial side of an upper to pass a ball.

FIG. 15 illustrates an embodiment of a player kicking ball 1505 with ball control portion 400, which may be used for passing, trapping and/or finesse moves. In this situation, the player is attempting to pass ball 1505 by contacting ball at the inside of the foot along ball control portion 400. Referring to FIG. 15, ball control portion 400 is contacting ball 1505. More specifically, third gripping member 430 is contacting the surface of ball 1505. By contacting ball 1505 with ball control portion 400, greater traction can be achieved with ball 1505 so that the player can make a more accurate pass.

In some cases, the sloped surface of third gripping member 430 may cause ball 1505 to travel in a generally downward direction 1515 after impact with the foot. In addition, in some cases, third gripping member 430 may compress and/or retract upon impact with ball 1505 and may reduce the overall velocity of ball 1505. In other embodiments, however, third gripping member 430 may be formed from material that is relatively rigid and not easily compressed.

Figure 17:
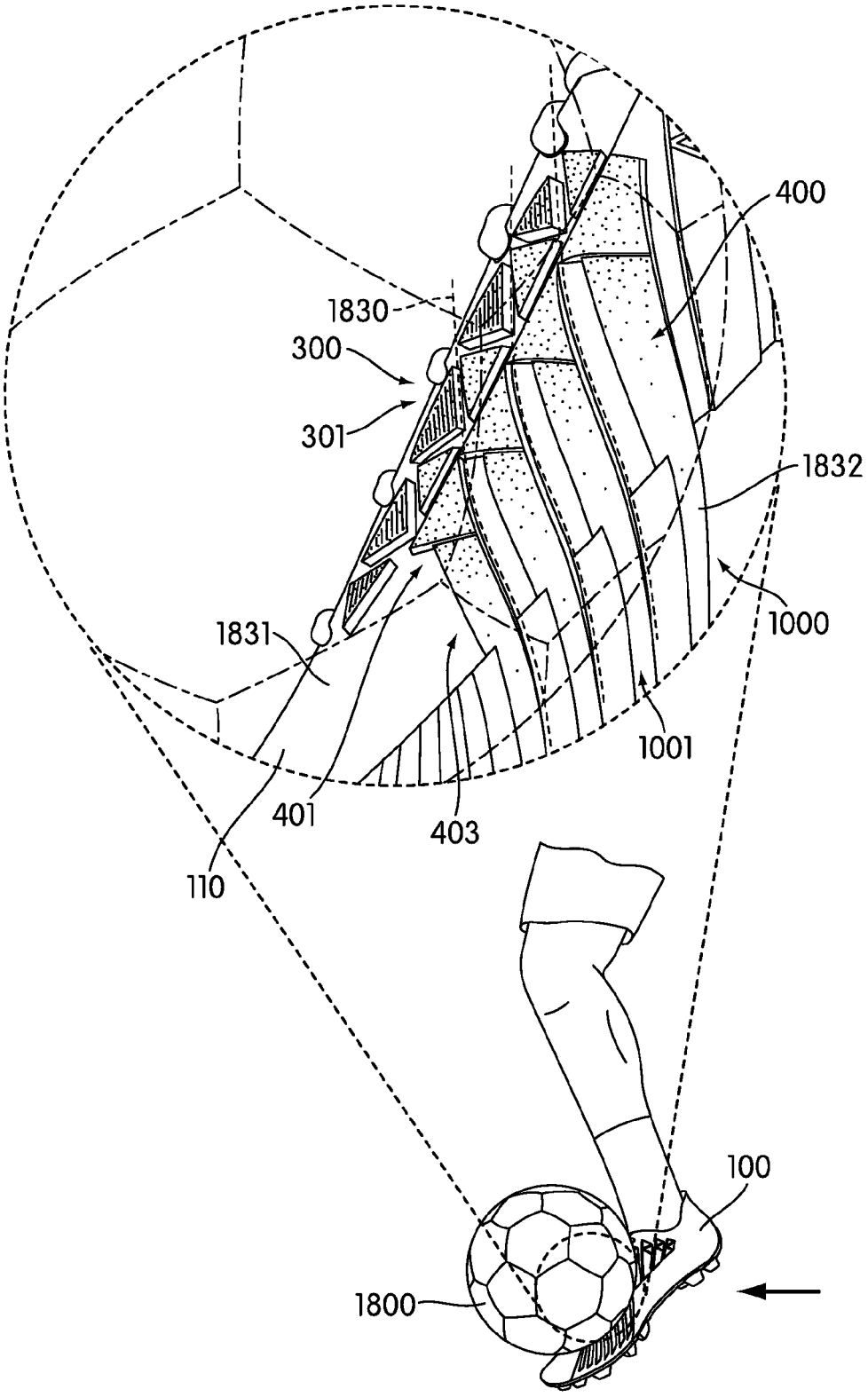
FIG. 17 is a view of one embodiment of a ball in contact with multiple ball control portions.

FIG. 17 illustrates an embodiment of a player utilizing ball control portion 1000 to impart sidespin on a ball 1705. Such a situation could occur when a player desires to kick a ball around an obstruction, such as an opposing player. In some embodiments, the player may be attempting to kick a banana kick, or otherwise impart sidespin on ball 1705. As can be seen in FIG. 17, ball control portion 1000 is contacting ball 1705. More specifically, plurality of protrusions 1110 may contact the surface of ball 1705. The impact between upper 110 and ball 1705 may bend plurality of protrusions 1110. The bending of the plurality of protrusions 1110 may impart sidespin on ball 1705 causing ball 1705 to spin in direction 1702.

Figure 16:
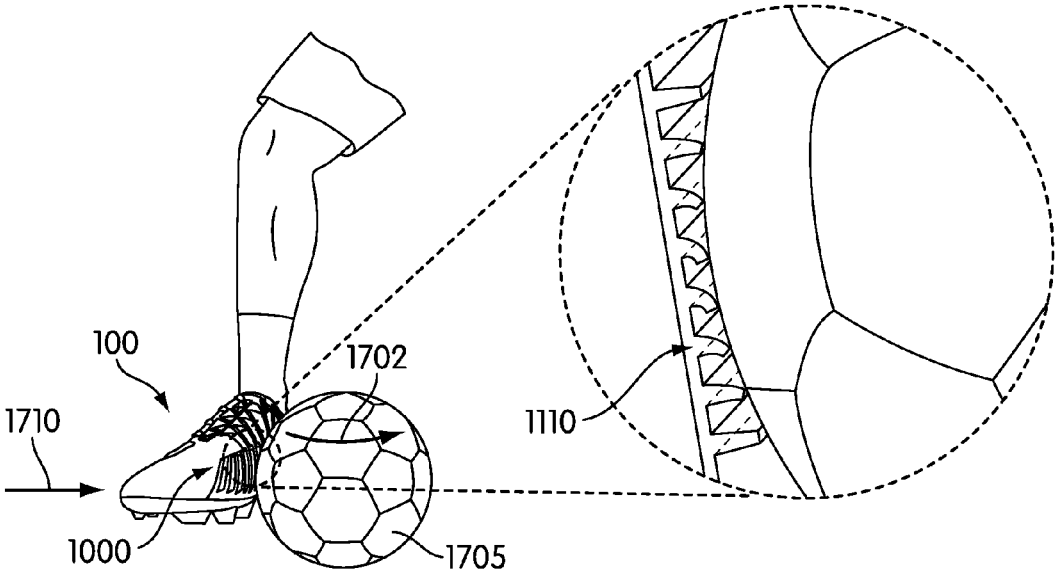
FIG. 16 is a view of one embodiment of a player using a ball control portion to apply side spin to a ball.

Although FIGS. 14 through 16 illustrate situations where a player uses a single ball control portion to contact a ball for assistance with a particular type of kick, there may be situations where a player intentionally or unintentionally contacts a ball with two or more ball control portions simultaneously. For example, FIG. 18 illustrates an embodiment of a view where a player is kicking ball 1800 using article 100. In this situation, ball 1800 may contact multiple ball control portions simultaneously. In particular, ball 1800 may come into contact with both first ball control portion 300 and second ball control portion 400.

As seen in the enlargement shown within FIG. 18, the arrangement of first group of gripping members 301, second group of gripping members 401 and third group of gripping members 403 within first ball control portion 300 and second ball control portion 400 helps provide a smooth transition between the two ball control portions and reduces corners and discontinuities that could alter the trajectory of a ball in an undesired manner. In this case, the approximate alignment of first group of gripping members 301 with second group of gripping members 401 and third group of gripping members 403 presents substantially continuous edges 1830 that extend from top portion 1831 of upper 110 to instep portion 1832 of upper 110. This helps maintain a substantially continuous contact area between ball 1800 and upper 110, so that the trajectory of ball 1800 can be accurately controlled. In particular, this arrangement helps to reduce the number of corners that are presented to a ball, in order to minimize unwanted variations in the trajectory of the ball.

The shape of edges 1830 may vary. In some cases, edges 1830 may be approximately straight edges. In other cases, edges 1830 may be approximately curved edges. Moreover, the shape of edges 1830 may vary according to the alignment of the associate gripping members.

In some embodiments, the materials used for one or more ball control components may vary. In some embodiments, gripping members, ball control structures and protrusions may be made of a substantially similar material. For example, in one embodiment, gripping members, ball control structures and/or protrusions may be made of a substantially monolithic molded material. Examples of materials for making ball control components include, but are not limited to: elastomers, siloxanes, natural rubber, synthetic rubbers, as well as any other materials. In some cases, materials with relatively high coefficients of friction can be used to increase grip on a ball. In other embodiments, however, a plurality of protrusions could be made of a substantially different material than gripping members and/or geometrically-shaped ball control structures. For example, in another embodiment, a base portion of a ball control component can be made of a material with a lower coefficient of friction than a material used for a plurality of protrusions. In some embodiments, one or more ball control structures may be formed from different materials.

While various embodiments have been described, the description is intended to be exemplary, rather than limiting and it will be apparent to those in the art that many more embodiments and implementations are possible that are within the scope of the current embodiments. Accordingly, the current embodiments are not to be restricted except in light of the attached claims and their equivalents. Features described in one embodiment may or may not be included in other embodiments described herein. Also, various modifications and changes may be made within the scope of the attached claims.

What is claimed is:

1. An article of footwear comprising:

an upper having an outer surface;

a first ball control portion disposed on the outer surface of the upper and a second ball control portion disposed on the outer surface of the upper, the first ball control portion being associated with a first type of kick and the second ball control portion being associated with a second type of kick that is different from the first type of kick;

the first ball control portion including a first gripping member and the second ball control portion including a second gripping member;

the first gripping member having a first height;

the first gripping member having an approximate shape of a triangular prism that is substantially constant throughout the first height;

the first gripping member having a to surface, wherein the to surface is substantially flat;

the second gripping member comprising a strip that has a substantially elongated shape;

the second gripping member having a to surface, wherein the top surface is substantially flat;

the first gripping member including a first edge and the second gripping member including a second edge; and wherein the first edge is approximately aligned with the second edge.

2. The article according to claim 1, wherein the first ball control portion further includes a third gripping member, the third gripping member having the approximate shape of a triangular prism, wherein the third gripping member is disposed adjacent to the first gripping member.

3. The article according to claim 2, wherein the first ball control portion comprises a first group of gripping members, and wherein the first group of gripping members form an inclined surface with respect to the outer surface of the upper, and wherein the inclined surface is configured to assist with low trajectory kicks.

4. The article according to claim 2, wherein the first ball control portion further includes a fourth gripping member, the fourth gripping member having the approximate shape of a triangular prism, wherein the fourth gripping member is disposed adjacent to the third gripping member, and wherein the first gripping member, the third gripping member, and the fourth gripping member are oriented in an interlocking configuration.

5. The article according to claim 4, wherein the arrangement of the first ball control portion provides an approximately continuous medial outer edge and an approximately continuous lateral outer edge.

6. The article according to claim 1, wherein the second gripping member comprises a first portion and a second portion, and wherein a slot is disposed between the first portion and the second portion.

7. The article according to claim 1, wherein the second ball control portion comprises a second group of gripping members, wherein the second group of gripping members form a contoured surface, and wherein the contoured surface is configured to assist with passes.

8. The article according to claim 1, wherein the first ball control portion is disposed adjacent to a lacing region of the upper.

9. The article according to claim 1, wherein the second ball control portion is disposed in an instep portion of the upper.

10. An article of footwear comprising:

an upper having an outer surface;

the upper also including a toe portion and an opening configured to receive a foot;

a first ball control portion disposed on the outer surface of the upper and a second ball control portion disposed on the outer surface of the upper;

the first ball control portion including a first gripping member, the first gripping member comprising a first height, the first gripping member comprising a raised structure with an approximately triangular cross-sectional shape that is substantially constant throughout the first height;

wherein the first ball portion forms a kicking surface, wherein the kicking surface increases in height in a direction extending from the toe portion towards the opening such that the kicking surface is inclined with respect to the outer surface of the upper;

the second ball control portion including a second gripping member, the second gripping member comprising a strip with a substantially elongated shape; and wherein the first gripping member is approximately aligned with the second gripping member.

11. The article according to claim 10, further including a vamp portion and a sole structure, wherein a first direction extends from the vamp portion towards the sole structure, wherein the second gripping member has a second height, and wherein the second height decreases along the first direction, such that the second gripping member has a downwardly sloped surface.

12. The article according to claim 10, wherein the second gripping member includes a length and a width and wherein the length is substantially greater than the width.

13. The article according to claim 10, wherein the first height of the first gripping member is approximately constant.

14. The article according to claim 10, wherein the first ball control portion further includes a third gripping member, wherein the third gripping member has a third height, wherein the third gripping member is disposed adjacent to the first gripping member, and wherein the first height varies from the third height.

15. The article according to claim 10, wherein at least one edge of the first gripping member is approximately aligned with at least one edge of the second gripping member.

16. The article according to claim 10, wherein the first gripping member has a compact shape.

17. An article of footwear comprising:

an upper having an outer surface;

a sole structure;

the upper also including a toe portion and an opening configured to receive a foot;

a first direction extending from the toe portion towards the opening;

a second direction extending from a vamp portion of the upper towards the sole structure;

a first group of gripping members disposed on the outer surface comprising a first ball control portion;

the first group of gripping members including a first gripping member, the first gripping member having a first height;

the first gripping member having a shape substantially similar to a triangular prism, wherein the shape of the first gripping member is substantially constant throughout the first height;

a second group of gripping members disposed on the outer surface comprising a second ball control portion;

the second group of gripping members including a second gripping member;

the second gripping member comprising a substantially elongated shape;

the first group of gripping members being approximately aligned with the second group of gripping members with respect to the second direction; and wherein the first ball control portion has a maximum height and a minimum height, such that the first group of gripping members collectively forms a kicking surface that is inclined along the first direction with respect to the outer surface of the upper.

18. The article according to claim 17, wherein a height of the second ball control portion varies along the second direction.

19. The article according to claim 17, wherein a first gripping member of the first group of gripping members has a first height and wherein a second gripping member of the first group of gripping members has a second height and wherein the first height is substantially different from the second height.

20. The article according to claim 19, wherein the first height is less than the second height.

21. The article according to claim 19, wherein the first gripping member is disposed closer to the toe portion than the second gripping member.

22. The article according to claim 17, wherein at least some of the edges of the first group of gripping members are aligned with at least some of the edges of the second group of gripping members.

23. The article according to claim 17, wherein the first ball control portion further comprises a third group of gripping members, and wherein the first group of gripping members are arranged in an interlocking configuration with the third group of gripping members.

24. An article of footwear comprising:

an upper including an outer surface;

a first gripping member extending over the outer surface of the upper, the first gripping member comprising a raised structure with an approximately triangular cross-sectional shape that is substantially constant throughout the first height;

the first gripping member having a top surface, wherein the top surface is substantially smooth;

a second gripping member extending over the outer surface of the upper, the second gripping member having an elongated shape;

the second gripping member having a to surface, the to surface including a plurality of protrusions;

the first gripping member including a first edge extending along a first length of the first gripping member and the second gripping member including a second edge extending along a second length of the second gripping member; and wherein the first edge is substantially aligned with the second edge.

25. The article according to claim 24, wherein the plurality of protrusions can bend with respect to the second gripping member.

26. The article according to claim 24, wherein the plurality of protrusions are configured to deform and provide an increase in contact surface with a ball.

27. The article according to claim 24, wherein the first gripping member is substantially wider than the second gripping member.

28. The article according to claim 24, wherein the first gripping member has a height that is approximately constant.

29. The article according to claim 24, wherein the second gripping member has a height that varies.

30. The article according to claim 24, wherein the first gripping member is approximately continuous with the second gripping member.

31. An article of footwear comprising:

an upper including an outer surface;

a first gripping member extending over the outer surface of the upper, the first gripping member having a shape substantially similar to a triangular prism;

a second gripping member extending over the outer surface of the upper and disposed adjacent to the first gripping member;

the second gripping member having an elongated shape;

a third gripping member extending over the outer surface of the upper, the third gripping member having the shape of a strip;

the third gripping member including a top surface, wherein a plurality of protrusions are disposed on the top surface of the third gripping member;

the second gripping member extending between the first gripping member and the third gripping member; and wherein the first gripping member, the second gripping member and the third gripping member are approximately aligned.

32. The article according to claim 31, wherein the first gripping member has a top surface, and wherein the to surface includes a plurality of recesses.

33. The article according to claim 32, further comprising a fourth gripping member, wherein the fourth gripping member has an approximately triangular prism shape, wherein the fourth gripping member is disposed adjacent to the first gripping member, wherein the fourth gripping member has a to surface, and wherein the to surface is substantially smooth.

34. The article according to claim 31, further comprising a fourth gripping member extending over the outer surface of the upper, the fourth gripping member having the shape of a strip, wherein the fourth gripping member is connected to the third gripping member by at least one connecting portion.

35. The article according to claim 31, wherein the second gripping member and the third gripping member are more elongate than the first gripping member.

36. An article of footwear, comprising:

a sole structure;

an upper including an outer surface;

a first gripping member extending over the outer surface of the upper, the first gripping member having a shape substantially similar to a triangular prism;

the first gripping member having a to surface, wherein the to surface is substantially flat;

a second gripping member extending over the outer surface of the upper, the second gripping member having an elongated shape, wherein the second gripping member has a first length;

a third gripping member extending over the outer surface of the upper, the third gripping member comprising a strip, wherein the third gripping member has a second length;

wherein the first length is less than the second length;

the second gripping member extending between the first gripping member and the third gripping member; and wherein the first gripping member, the second gripping member and the third gripping member present an approximately continuous edge along the outer surface of the upper.

37. The article according to claim 36, further including a toe portion, an opening configured to receive a foot, and a fourth gripping member, wherein a first direction extends from the toe portion towards the opening, wherein the fourth gripping member has an approximately triangular prism shape, wherein the fourth gripping member is disposed adjacent to the second gripping member, and wherein the height of the fourth gripping member increases along the first direction, such that the fourth gripping member has an upwardly sloped surface.

38. The article according to claim 37, wherein the fourth gripping member and the second gripping member present a substantially smooth contoured surface.

39. The article according to claim 36, wherein the second gripping member comprises a first portion and a second portion, and wherein a slot is disposed between the first portion and the second portion.

40. The article according to claim 36, wherein the first gripping member has a shape substantially similar to a uniform triangular prism.

41. The article according to claim 36, wherein the edge extends from a vamp portion of the upper towards the sole structure of the article.

42. The article according to claim 36, wherein the edge is curved.

* * * * *